US005723277A

United States Patent [19]

Nabeta

[11] Patent Number: 5,723,277

[45] Date of Patent: Mar. 3, 1998

[54] SILVER HALIDE EMULSION AND SILVER HALIDE COLOR PHOTOGRAPHIC MATERIAL USING THE SAME

[75] Inventor: Toshiuki Nabeta, Kanagawa, Japan

[73] Assignee: Fuji Photo Film Co., Ltd., Kanagawa, Japan

[21] Appl. No.: 649,273

[22] Filed: May 17, 1996

[30] Foreign Application Priority Data

May 17, 1995 [JP] Japan ..... 7-141377

[51] Int. Cl.[6] ..... G03C 1/035; G03C 1/42

[52] U.S. Cl. ..... 430/567; 430/569; 430/506; 430/566

[58] Field of Search ..... 430/567, 569, 430/566, 506

[56] References Cited

U.S. PATENT DOCUMENTS 5,565,315 10/1996 Yamashita ..... 430/567
5,637,446 6/1997 Yamashita ..... 430/567

FOREIGN PATENT DOCUMENTS 0 584 644 A2 3/1994 European Pat. Off. ..... G03C 1/005
6-59360 3/1994 Japan ..... G03C 1/015

*Primary Examiner*—Mark F. Huff

[57] ABSTRACT

Disclosed is a silver halide emulsion containing tabular silver halide grains in such an amount that the projected area of the tabular silver halide grains accounts for 30% or more of the entire projected area of silver halide grains contained in the emulsion, the tabular silver halide grains having: (1) a multiple structure comprising one inner shell and one or more outer shells positioned outside of the inner shell, wherein the outermost shell of the outer shells contains 50 mol % or more of silver chloride and at least one of the outer shells and the inner shell which are positioned inside of the outermost shell contains 50 mol % or more of silver bromide; (2) {100} faces as two main planes parallel to each other; and (3) an aspect ratio of 2 or more. The silver halide emulsion is excellent in rapid processing suitability, has high sensitivity, and shows photographic performance such as superior graininess.

18 Claims, No Drawings

SILVER HALIDE EMULSION AND SILVER HALIDE COLOR PHOTOGRAPHIC MATERIAL USING THE SAME

FIELD OF THE INVENTION

The present invention relates to a silver halide color photographic material and, in particular, to a silver halide color photographic material which is excellent in rapid processing suitability, has high sensitivity, and shows photographic performance such as superior graininess and the processing stability, and also relates to a method of formation of silver halide image.

BACKGROUND OF THE INVENTION

Silver halide color photographic materials which are now on the market and image forming methods using these materials are diversified and are utilized in various fields.

The halide compositions of the silver halide emulsions which are used for these various photographic materials comprise in most cases silver iodobromide or silver chloroiodobromide comprising silver bromide as a major component for the purpose of attaining high sensitivity, and a tabular silver halide grain which has various characteristics due to its shape has become to be used.

On the other hand, the demand for rapid processing of color photographic materials has become increasingly strong in recent years, and to meet this purpose, it is necessary to provide silver halide color photographic materials using silver halide emulsions comprising silver chloride as a major component.

As a conventionally known technique using silver halide emulsions comprising silver chloride as a major component, for example, the silver halide grains having a layer structure composed of a core part of a high silver bromide content layer and an outermost layer of silver chloride is disclosed in JP-A-61-215540 (the term "JP-A" as used herein means an "unexamined published Japanese patent application"), which unites excellent developing ability of silver chloride and high sensitivity of silver bromide. However, it has been found that the crystal phase of the silver halide grain disclosed therein is a cubic grain not having twin planes and the amount of the sensitizing dye to be used therein is small and light absorption lowers because the grain has a small surface area, therefore, in particular, sufficient sensitivity cannot be obtained.

On the other hand, tabular grains of silver chloride having {100} faces as main planes are disclosed in JP-A-5-204073, and it is expected that when these grains are used in a silver halide color photographic material, a photographic material which is excellent in rapid processing suitability and has high sensitivity can be obtained. However, tabular grains of a high silver chloride content are difficult to control the amount of developed silver during development and the developed silver is liable to increase, as a result, the remaining silver due to bleaching failure after development processing becomes a problem.

As described above, there are no reports teaching about the method of preparing silver halide tabular grains comprising an outermost layer shell of a high silver chloride content and an inside part of a high silver bromide content and having {100} faces as main planes, and accordingly, known techniques have not been able to provide the silver halide tabular grains having the above structure.

SUMMARY OF THE INVENTION

An object of the present invention is to provide a silver halide color photographic material which is excellent in rapid processing suitability, has high sensitivity, and shows photographic performance such as superior graininess.

The above object of the present invention could be attained by the following method.

(1) A silver halide emulsion containing tabular silver halide grains in such an amount that the projected area of the tabular silver halide grains accounts for 30% or more of the entire projected area of silver halide grains contained in the emulsion, the tabular silver halide grains having:

(a) a multiple structure comprising one inner shell and one or more outer shells positioned outside of the inner shell, wherein the outermost shell of the outer shells contains 50 mol % or more of silver chloride and at least one of the outer shells and the inner shell which are positioned inside of the outermost shell contains 50 mol % or more of silver bromide;

(b) {100} faces as two main planes parallel to each other; and (c) an aspect ratio of 2 or more.

(2) The silver halide emulsion described in (1), wherein the silver amount of the outermost shell accounts for 15 mol % or more of that of the entire silver halide grain.

(3) A silver halide photographic material comprising a support having thereon at least one red-sensitive silver halide emulsion layer, at least one green-sensitive silver halide emulsion layer, at least one blue-sensitive silver halide emulsion layer, and at least one light-insensitive layer, a color developing agent, and a coupler which forms a dye on coupling reaction with the oxidation product of the color developing agent, wherein at least one layer of the red-sensitive silver halide emulsion layer, green-sensitive silver halide emulsion layer, and blue-sensitive silver halide emulsion layer contains a silver halide emulsion containing a silver halide emulsion described in (1) or (2).

(4) The silver halide color photographic material described in (3), wherein the amount of the color developing agent incorporated in the photographic material is from 0.5 to 40 mol % based on the total amount of the light-sensitive silver halide contained in the photographic material.

(5) The silver halide color photographic material described in (3) or (4), which comprises two or more light-sensitive silver halide emulsion layers having the same color sensitivity but different sensitivity and each containing a color developing agent, wherein the molar ratio of the amount of the color developing agent to the amount of the light-sensitive silver halide in the silver halide emulsion layer having higher sensitivity is smaller than that in the silver halide emulsion layer having lower sensitivity.

Further, the present invention provides a method of color image formation comprising processing a silver halide light-sensitive material as described in (1), (2), (3), (4) or (5) above using a processing solution substantially not containing a color developing agent.

A tabular silver halide emulsion which does not produce the remaining silver due to bleaching failure after development processing, and has excellent rapid processing ability and high sensitivity can be realized by the emulsion grain of the present invention comprising a multiple structure of an outermost shell containing silver chloride which has an excellent developing ability and an outer shell or an inner shell positioned inside of the outermost shell containing silver bromide which controls development progress.

DETAILED DESCRIPTION OF THE INVENTION

The tabular silver halide grains having a multiple structure of the present invention is described below.

The inner shell of the silver halide grains of the present invention indicates monodispersed grains which are obtained after nucleus formation and ripening processes of a series of grain forming process (nucleus formation—ripening —growth).

Further, the outer shell indicates the grown part when the inner shell is subjected to a growing process by means of an ion addition method or a fine grain addition method. Accordingly, the outer shell means the grown part which completely covers the inner shell, the parts grown on two or more planes perpendicular to two main planes parallel to each other of the inner shell as starting points, and the grown parts by both of these growing processes.

Further, the multiple structure of the silver halide grains of the present invention means the structure having two or more regions of different halide compositions in one grain. That is, the multiple structure herein is the structure in which an outer shell and an inner shell are formed of different halide compositions, or the structure in which the growth of the outer shell is separated to several stages and each outer shell is grown by different halide compositions.

The outermost shell is the finally grown part of the grain when the growing process is conducted with making the inner shell as a base. The finally grown part as used herein means when the growing process comprises one stage, the grown part formed by this growing process, and when the growing process of the outer shell comprises several stages, it means the grown part of the grain formed by the final growing stage.

The outermost shell accounts for 15 mol % or more, preferably from 20 to 50 mol %, more preferably from 20 to 40 mol %, of the silver amount of the entire silver halide grains.

Preferred conditions of the halide composition of the silver halide grains having a multiple structure are described below.

The outermost shell comprises mixed crystals of silver bromide, silver iodide and silver iodobromide containing silver chloride in an amount of 50 mol % or more, preferably 70 mol % or more, and more preferably 90 mol % or more, or pure silver chloride.

At least one outer shell or inner shell positioned inside of the outermost shell comprises mixed crystals of silver chloride, silver iodide and silver iodochloride containing silver bromide in an amount of 50 mol % or more, preferably 60 mol % or more, and more preferably 70 mol % or more, or pure silver bromide.

Halide compositions of other shells present in the tabular grains having a multiple structure may be silver chloride, silver bromide, silver iodobromide and mixed crystals of two or more thereof.

The silver halide tabular grains of the present invention comprise a multiple structure having two or more layers, the lower limit of the layers is preferably five layers or less, and more preferably four layers or less. Further, an interlayer may be provided between arbitrary two layers. The boundary between the arbitrary two layers is not necessary to have clear difference in the halide composition.

The main plane of the tabular grain is defined as a pair of parallel planes having the largest area of the crystal surfaces forming a substantially rectangular emulsion grain, and whether the main planes have {100} faces or not can be examined using electron diffraction and X-ray diffraction. Substantially rectangular emulsion grain means that the main planes comprise {100} faces but the case in which from one to eight planes comprise {111} crystal face is possible. That is, from 1 to 8 of eight corners of the rectangular parallelopiped may be rounded in shape. One preferred mode is such that the shape of the main plane is rectangular parallelogram, and the ratio of adjacent sides of the main plane [(length of long side/length of short side) of one grain] is preferably from 1 to 10, more preferably from 1 to 5, and most preferably from 1 to 2.

The aspect ratio of the tabular grain is 2 or more, preferably 4 or more, and more preferably from 4 to 20. The term "aspect ratio" as used herein means the value obtained by dividing a circle-corresponding diameter of the tabular grain (the diameter of a circle having the same area as projected area of the tabular grain) by the thickness of the grain (the distance of two main planes). The thickness is preferably 0.5 μm or less, more preferably from 0.03 to 0.3 μm, and most preferably from 0.05 to 0.2 μm.

The circle-corresponding diameter of the tabular grains is preferably 10 μm or less, more preferably from 0.2 to 5 μm. The distribution of the circle-corresponding diameter is preferably monodisperse, and the variation coefficient of the distribution (standard deviation/average diameter) is preferably from 0 to 0.4, more preferably from 0 to 0.3, and most preferably from 0 to 0.2.

Further, the tabular grains of the present invention account for 30% or more, preferably 50% or more, and more preferably 80% or more, of the entire projected area. The projected area herein means a projected area of grains when the silver halide emulsion grains are disposed on a substrate so that the grains do not overlap each other and the main planes of the tabular grains are parallel to the substrate.

Method of Analyzing Composition of Grain Having Multiple Structure

Each composition in the grains having a multiple structure of the present invention can be determined by X-ray diffraction. Examples of applying X-ray diffraction to silver halide grains are disclosed, for example, in H. Hirsch, *Journal of Photographic Science*, Vol. 10 (1962), from Item 129 et seq.

A lattice constant is determined by composition of silver halide, and a diffraction peak appears at diffraction angles satisfying Bragg condition ($2d \sin\theta = n\lambda$). As a standard method, there is a method searching for diffraction curve of {220} face of silver halide as a target using a line source of K β line of Cu.

When the emulsion grain has a structure composed of two distinct layers, two diffraction maxima appear correspondingly to different halide compositions of the two layers, as a result, two peaks appear on the diffraction curve. In practice, a technique for disassembling a diffraction curve consisting of two diffraction components is well known. Each composition can be derived by Vegard's rule by separating two components assuming that each diffraction component being a function such as Gauss function or Lorentz function.

On the other hand, in X-ray diffraction of an emulsion containing two kinds of grains which have different halide compositions and do not have a structure composed of two distinct layers, two peaks appear, but such an emulsion cannot provide excellent photographic characteristics.

Whether the silver halide emulsion is the emulsion within the scope of the present invention or the emulsion in which two kinds of silver halide grains coexist as described above can be determined, in addition to X-ray diffraction, by EPMA (Electron-Probe Micro Analyzer).

According to this method, a sample of emulsion grains well dispersed so as not to contact with each other is prepared and irradiated with an electron beam. According to this method, elemental analysis of a super-micro part can be conducted by X-ray analysis by electron beam excitation. The halide composition of each grain can be determined by searching for characteristic X-ray strength of the silver and halogens released from each grain.

Whether the emulsion is within the scope of the present invention or not can be determined by confirming the halide compositions of at least 50 grains by EPMA.

It is preferred that the halogen content among the silver halide grains of the present invention is more uniform.

When the distribution of the halogen content among the grains is measured according to EPMA, the relative standard deviation is preferably 50% or less, more preferably 35% or less, and particularly preferably 20% or less.

Further, the total amount of the silver bromide present in the grains of the silver halide emulsion of the present invention can be determined by the above X-ray diffraction after annealing each sample.

The total amount of the silver bromide present in the grains of the silver halide emulsion of the present invention at that time is preferably 50 mol % or more, more preferably 55 mol % or more, of the entire amount of the silver halide.

The tabular grains having a multiple structure of the present invention can be prepared according to the following method.

(1) Process of Nucleus Formation

First of all, $Ag^+$ and halide ($X_1^-$) are reacted with stirring in a solution of a dispersion medium comprising at least a dispersion medium and water to prepare a silver halide host nucleus. Subsequently, a different kind of halide $X_2^-$ solution or impurities (e.g., yellow prussiate of potash and the like) is/are added thereto and a dislocation line which is the origin of the formation of the tabular grain is substantially formed. For the formation of the dislocation line, the reaction condition should be the atmosphere of {100} face formation. Further, the process of the formation of the dislocation line requires a certain period of time (preferably 3 minutes or more), the reaction system should be allowed to stand as it is without newly adding anything after the addition of the different kind of $X_2^-$ solution or impurities.

The temperature of the nucleus formation is preferably from 20° to 80° C., more preferably from 25° to 50° C. For the purpose of forming a nucleus of a smaller size, the nucleus formation is preferably conducted at low temperature. However, since the formation of the dislocation line requires a certain energy, temperature difference may be made between the nucleus formation and the dislocation line formation.

In the process of the dislocation line formation, dislocation lines can be introduced into grains by halide gap or impurities, but when the number of the dislocation lines introduced into the grains is three or more, the grains finally obtained are thick grains having a low aspect ratio which had been subjected to growing-acceleration in the directions of x, y and z axes. Herein, x and y axes are parallel to the main planes and orthogonal to each other and z axis is perpendicular to the main planes. Accordingly, it is preferred to control the probability of the formation of dislocation lines so that the probability of the formation of thick grains is less and the probability of the formation of the tabular grains is high. Specifically, a method of selecting the kinds and addition amounts of different kind of halogen $X_2^-$ and impurities optimally is most effective.

2) Process of Ripening

It is difficult to form only the tabular grain nuclei selectively during nucleus formation. Accordingly, the grains other than the tabular grains are dissolved by Ostwald ripening in the succeeding ripening process. The temperature of ripening is preferably higher than the temperature of nucleus formation by 10° C. or more, generally at 50° to 90° C. Non-tabular grains are dissolved by ripening and deposited on the tabular grains. Fine grains having such a composition and size that they are apt to dissolve as compared with the tabular grains are preferably present at the early stage of the ripening so that the tabular grains are difficult to vanish at the early stage of the ripening. Further, it is desired that the introduction of new dislocation line should not occur during ripening and, for the sake of it, it is preferred to pass enough time after the addition of different halides or impurities to get into an equilibrium condition or to reduce the effects of different halides and impurities as far as possible to nearly zero by the addition of the halide having the same composition as $AgX_1$.

3) Process of Grain Growth

The thus-formed tabular inner nucleus grains through nucleus formation—ripening processes may be laminated with outer shells in the succeeding process of crystal growth, or the inner nucleus grains may further be grown to a desired size, then laminated with outer shells. The methods therefor include 1) an ion addition method in which the grains are grown by adding an $Ag^+$ salt solution and an $X^-$ salt solution under low supersaturated concentration, 2) a fine grain addition method in which grains are grown by adding AgX fine grains previously formed, and 3) a method of combination of 1) and 2).

1) Ion Addition Method

In the ion addition method, an $Ag^+$ salt solution and an $X^-$ salt solution are added by a controlled double jet method at an addition rate of substantially not generating novel nuclei and maintaining the potential of the solution constant. The term "Substantially" as used herein means the increasing ratio of the projected area attributable to the nuclei formed newly is preferably 10% or less, more preferably 1% or less, and most preferably 0.1% or less.

Further, the halide composition of the $X^-$ salt solution when forming the outermost shell in the multiple tabular grains of the present invention comprises pure silver chloride, or silver bromide or silver iodide having a silver chloride content of 50 mol % or more, preferably 70 mol % or more, more preferably 90 mol % or more, or mixed crystals of two or more of them.

2) Fine Grain Addition Method

In the method of addition of a fine grain emulsion, a silver halide fine grain emulsion having a grain size of generally 0.15 μm or less, preferably 0.1 μm or less, and more preferably 0.06 μm or less is added to grow the tabular grains by Ostwald ripening. The fine grain emulsion can be added either continuously or intermittently. The fine grain emulsion can be prepared continuously in a mixing vessel provided near the reaction vessel by supplying a silver salt aqueous solution and a halide salt aqueous solution and can be added immediately and continuously to the reaction vessel, or may be previously prepared in another vessel in a batch system and added to the reaction vessel continuously or intermittently. It is preferred that the fine grains substantially do not contain twin grains. This means that the ratio by number of twin grains is 5% or less, preferably 1% or less, and more preferably 0.1% or less.

Further, the halide composition of the fine grains when forming the outermost shell in the multiple tabular grains of the present invention comprises pure silver chloride, or silver bromide or silver iodide having a silver chloride content of 50 mol % or more, preferably 70 mol % or more, more preferably 90 mol % or more, or mixed crystals of two or more of them.

The conditions of the solution during grain growth are the same as those during ripening. This is because both steps are to grow the tabular grains by Ostwald ripening and dissolve the grains other than the tabular grains and are the same in mechanism. With respect to the entire details of the addition method of the fine grain emulsion, the descriptions in JP-A-4-34544, JP-A-5-281640, and JP-A-1-183417 can be referred to.

The fine grains not substantially containing twin planes can be formed by addition of a silver salt aqueous solution and a halide salt aqueous solution by a double jet method with a concentration of excessive halogen ion or excessive silver ion being preferably $10^{-2}$ mol/liter or less.

The temperature during fine grain formation is preferably 50° C. or less, more preferably from 5° to 40° C., and most preferably from 10° to 30° C. Gelatin in which low molecular weight gelatin having a molecular weight of preferably from 2,000 to $6\times10^4$, more preferably from 5,000 to $4\times10^4$, accounts for preferably 30 wt % or more, more preferably 60 wt % or more, and most preferably 80 wt % or more is preferred as a dispersion medium. The concentration of the dispersion medium is preferably 0.2 wt % or more and more preferably from 0.5 to 5 wt %.

Dislocation lines can be introduced into the tabular grains having a multiple structure of the present invention during grain formation by a halide composition gap method, a halogen conversion method, an epitaxial growth method and combinations thereof. This is preferred for further improving stress fog characteristics, reciprocity law characteristics and color sensitization characteristics. With respect to this, JP-A-63-220238, JP-A-64-26839, JP-A-2-127635, JP-A-3-189642, JP-A-3-175440, JP-A-2-123346, EP 460656 Al and *Journal of Imaging Science*, Vol. 32, pages 160 to 177 (1988) can be referred to.

As an effective method of adsorbing sensitizing dyes onto the tabular grains of a multiple structure of the present invention more uniformly, there is a method of forming a salt being more slightly-soluble than silver chloride on the high silver chloride content surface of the outermost shell uniformly among grains to adsorb the sensitizing dye onto the grains uniformly.

Examples of a silver salt being more slightly-soluble than silver chloride include silver bromide, silver iodide, silver iodobromide, silver thiocyanate, silver selenocyanate and mixed crystals of them, with silver bromide, silver iodide, and silver iodobromide being preferred. The amount of the silver salt being more slightly-soluble than silver chloride is generally 20 mol % or less, preferably 10 mol % or less, more preferably 5 mol % or less, most preferably 3 mol % or less based on the entire grains, with the lower limit being preferably 0.001 mol %.

Methods for introducing silver salts more slightly-soluble than silver chloride on the surface of the tabular grains include a method of adding water-soluble halide salt and water-soluble silver salt having corresponding compositions by a double jet method, a method of adding fine grains and a method of using an agent of gradually releasing a bromine ion or iodine ion (releasing agent).

In the method of adding water-soluble halide salt and water-soluble silver salt by a double jet method, halogen ion is added in a free state even if the halide salt aqueous solution and the like are added after being diluted, therefore, there is limitation on reducing the locality among grains. On the contrary, methods of adding fine grains or using a releasing agent are preferred because more slightly-soluble salts than silver chloride are formed on the surface of the grains without nonuniformity among grains.

In the case where fine grains are added, the average of the sphere-corresponding diameter (diameter of a sphere having the same volume as the grain) of the grains is preferably 0.1 μm or less, more preferably 0.06 μm or less. The fine grains can be prepared continuously in a mixing vessel provided near the reaction vessel by supplying a silver salt aqueous solution and an aqueous solution of a salt capable of forming a silver salt having a lower solubility than silver chloride and can be added immediately to the reaction vessel, or may be previously prepared in another vessel in a batch system and added to the reaction vessel. Further, the method using a releasing agent as disclosed in JP-B-1-285942 (the term "JP-B" as used herein means an "examined Japanese patent publication") and JP-A-6-11780 can be applied.

The developing agents for use in the present invention are described below. A developing agent which is used in a silver halide color photographic material, in general, imagewise reduces silver halide directly or via other electron transfer agents and produces the oxidation product of a developing agent corresponding to exposure amount. The oxidation product of a developing agent further reacts with a coupler and forms a dye. In usual color photographic systems in recent years, a developing agent is contained in a developing solution and the developing agent is permeated into a photographic material during development processing and the development proceeds. That is, a high reactive developing agent is always supplied as a fresh one during development processing (a developing agent easily decomposes by air oxidation as it is a reducing agent). On the other hand, as the developing agent for use in the present invention is contained in a photographic material, it is required to be provided with characteristics which are seemingly contradictory such that the storage stability before and after development processing is excellent and the developing activity during development processing is high. That is, a developing agent for use in ordinary photographic processing cannot be used as it is (from the point of the storage stability), and a developing agent which is designed to raise the oxidation potential for the purpose of meeting the storage stability cannot manifest sufficient developing activity during processing. One method to cope with this problem is to use a compound obtained by introducing an electron attractive group releasable during color development processing into a compound having a developing activity, as a developing agent. This developing agent can be represented by the following formula (D-1):

$$(L)_n—D \qquad \text{(D-1)}$$

wherein L represents an electron attractive group releasable during development processing; D represents a compound residue obtained by removing n hydrogen atoms from a compound $H_nD$ having a developing activity; and n represents an integer of from 1 to 3.

The developing agent represented by formula (D-1) preferably has the structure represented by the following formula (D-2):

$$L^1L^2N—(NH)_p—(X=Y)_q—Z \qquad \text{(D-2)}$$

wherein $L^1$ and $L^2$ each represents a hydrogen atom or an electron attractive group releasable during color development processing, and $L^1$ and $L^2$ do not represent hydrogen atoms at the same time; X and Y independently represent methine or azomethine; Z represents a hydrogen atom, a hydroxyl group, an amino group or —$NHL^3$; $L^3$ represents an electron attractive group; p represents 0 or an integer of 1; q represents an integer of from 1 to 3; and arbitrary two of $L^1$, $L^2$, X, Y and Z may be linked to form a ring.

The preferred range of the developing agent represented by formula (D-2) is described in detail below. Preferred examples of the electron attractive group represented by $L^1$ and $L^2$ in formula (D-2) include a formyl group, an acyl group, a sulfinyl group, a sulfonyl group and a phosphonyl group, and particularly preferred are an acyl group and a sulfonyl group. $L^1$ and $L^2$ are released in color development processing and they may be released either after or before the developing agent represented by formula (D-2) is oxidized. However, the constitution in which the developing agent for use in the present invention imagewise develops silver halide under a basic condition, the oxidation product of the developing agent produced at that time coupling reacts with a coupler, then $L^1$ and $L^2$ are released, and a dye is formed is preferred from the viewpoint that the development is preferred not to exceed at an unexposed part (prevention of fog) and the viewpoint of preventing a coloring material from being formed by the unreacted development activating seed, which has been produced in development processing, remaining in the photographic material (prevention of stain). $L^1$ and $L^2$ may be released in the form of an anion or a radical, or may be decomposed and released by nucleophilic attack by the nucleophilic seed in a developing solution (water, hydroxide ion, hydrogen peroxide, sulfite ion, hydroxylamine), and particularly in the latter case, the release of $L^1$ and $L^2$ can be accelerated by adding positively a nucleophilic seed to the developing solution, or when a compound accelerating silver development (particularly preferably hydrogen peroxide) is added, the release of $L^1$ and $L^2$ can be accelerated making use of the nucleophilicity thereof.

In formula (D-2), $(X{=}Y)_q$ represents a π electron conjugated system by a carbon atom or a nitrogen atom, X and Y are particularly preferably linked to form a ring, q is preferably 2 or 3, and the number of the nitrogen atom contained is preferably from 0 to 3. When $(X{=}Y)_q$ forms a ring, a 5- or 6-membered ring is preferred, and a hetero atom may be contained as a constituting atom of the ring, with a preferred hetero atom being a nitrogen atom, an oxygen atom and a sulfur atom, particularly preferably a nitrogen atom. Further, $(X{=}Y)_q$ may have a condensed ring, and a benzene ring is preferred as the condensed ring.

When p represents 0, X bonding to $L^1L^2N$ may be either of a carbon atom or a nitrogen atom, but when p represents 1, X bonding to NH is preferably a carbon atom.

In formula (D-2), when p represents 0, Z is preferably a hydroxyl group, an amino group or $NHL^3$, and when p represents 1, Z is preferably a hydrogen atom or $NHL^3$. When Z is represented by $NHL^3$, $L^3$ is preferably a formyl group, an acyl group, a sulfinyl group, a sulfonyl group or a phosphonyl group, and particularly preferably an acyl group or a sulfonyl group.

The developing agent represented by formula (D-2) is preferably introduced into a photographic material by a method of dissolving in a high boiling point organic solvent, followed by emulsion dispersing, a so-called oil-protecting method. Accordingly, the developing agent for use in the present invention preferably has a comparatively large lipophilic group generally called a ballast group for easily dissolving in a high boiling point organic solvent and maintaining a stability in a photographic material. Therefore, it is preferred that this ballast group contain straight chain or branched alkyl group(s) of a certain degree of a bulk, and the total carbon atom number of these alkyl groups is preferably from 8 to 32, more preferably from 12 to 22, and particularly preferably from 12 to 18. The substitution position of the ballast group may be $L^1$, $L^2$, (X=Y) or Z, but $L^1$ or $L^2$ is preferred.

The developing agent represented by formula (D-2) may have substituents for acquiring suitable pKa (acid dissociation constant) corresponding to pH of a developing solution to be used, and for adjusting the absorption wavelength of a dye to be formed, releasing rate of $L^1$ and $L^2$, coupling rate with a coupler, and an oxidation potential to objective ranges. Examples of the substituent include a halogen atom, a cyano group, a nitro group, an amino group, a carboxyl group, a sulfo group, an acyl group, an acylamino group, a carbamoyl group, a sulfonyl group, a sulfonylamino group, a sulfamoyl group, an alkyl group, an aryl group, an alkoxy group and an aryloxy group. An electron attractive group is preferred, and a halogen atom, a cyano group, an acyl group, a carbamoyl group, a sulfonyl group and a sulfamoyl group are particularly preferred.

The developing agents represented by formula (D-2) are particularly preferably represented by the following formulae (D-3) to (D-10):

| | |
|---|---|
| $R^1SO_2NH\text{-}\phi^1\text{-}NR^2R^3$ | (D-3) |
| $R^4SO_2NH\text{-}\phi^2\text{-}OH$ | (D-4) |
| $R^5CONH\text{-}\phi^3\text{-}NR^6R^7$ | (D-5) |
| $R^8CONH\text{-}\phi^4\text{-}OH$ | (D-6) |
| $R^9SO_2NHNHR^{10}$ | (D-7) |
| $R^{11}CONHNHR^{12}$ | (D-8) |
| $R^{13}SO_2NHN{=}\phi^5$ | (D-9) |
| $R^{14}CONHN{=}\phi^6$ | (D-10) |

In formulae (D-3) to (D-10), $R^1$ to $R^4$, $R^6$, $R^7$, $R^9$, $R^{10}$, $R^{12}$ and $R^{13}$ represent an alkyl group, an aryl group or a heterocyclic group; $R^5$, $R^8$, $R^{11}$ and $R^{14}$ represent a hydrogen atom, an alkyl group, an aryl group, a heterocyclic group, an alkoxy group, an aryloxy group or an amino group; $\phi^1$ to $\phi^4$ represent an arylene group or a heteroarylene group; and $\phi^5$ and $\phi^6$ represent a hydrocarbon ring group or a heterocyclic group bonded to a nitrogen atom by a double bond.

In formulae (D-3) to (D-10), the alkyl group represented by $R^1$ to $R^{14}$ is preferably a straight chain or branched, or acyclic or cyclic alkyl group having from 1 to 30 carbon atoms, and particularly preferred is a straight chain alkyl group having from 1 to 22 carbon atoms such as methyl, ethyl, propyl, butyl, dodecyl, tetradecyl, hexadecyl, and octadecyl.

In formulae (D-3) to (D-10), the aryl group represented by $R^1$ to $R^{14}$ is preferably an aryl group having from 6 to 20 carbon atoms, more preferably an aryl group having from 6 to 10 carbon atoms such as phenyl, naphthyl, anthrathenyl, and most preferably phenyl.

In formulae (D-3) to (D-10), the heterocyclic group represented by $R^1$ to $R^{14}$ is preferably a 5- to 7-membered heterocyclic group, the hetero atom is preferably a nitrogen atom, an oxygen atom or a sulfur atom, and the number of the carbon atom is preferably from 1 to 10. Particularly preferred examples include a nitrogen-containing 5- or 6-membered heterocyclic group such as 2-imidazolyl, 1,3-oxazol-2-yl, 1,3-thiazol-2-yl,5-tetrazolyl, 3-indolinyl, 1,3,4-thiadiazol-2-yl, 1,3-benzoxazol-2-yl, 1,3-benzothiazol-2-yl, 1,3-benzimidazol-2-yl, 1,2,4-triazol-5-yl, 3-pyrazolyl, 2-pyridyl, 3-pyridyl, 4-pyridyl, 2-pyrimidyl, and 3-pyrimidyl. Further, they may have a condensed ring, and a benzene ring is preferred as the condensed ring.

In formulae (D-5), (D-6), (D-8) and (D-10), the alkoxy group represented by $R^5$, $R^8$, $R^{11}$ and $R^{14}$ is preferably a straight chain or branched, or acyclic or cyclic alkoxy group having from 1 to 30 carbon atoms, and particularly preferred is a straight chain alkoxy group having from 1 to 22 carbon atoms such as methoxy, ethoxy, propyloxy, butyloxy, dodecyloxy, tetradecyloxy, hexadecyloxy, and octadecyloxy.

In formulae (D-5), (D-6), (D-8) and (D-10), the aryloxy group represented by $R^5$, $R^8$, $R^{11}$ and $R^{14}$ is preferably an aryloxy group having from 6 to 20 carbon atoms, more preferably an aryloxy group having from 6 to 10 carbon atoms as phenoxy, naphthoxy, and anthrathenoxy, and most preferably a phenoxy group.

In formulae (D-5), (D-6), (D-8) and (D-10), the amino group represented by $R^5$, $R^8$, $R^{11}$ and $R^{14}$ is preferably an alkylamino group, a dialkylamino group, an arylamino group, a diarylamino group and an alkylarylamino group, each having from 2 to 40 carbon atoms, more preferably an alkylamino group, a dialkylamino group and an arylamino group, each having from 1 to 20 carbon atoms, such as methylamino, ethylamino, diethylamino, di-n-octylamino, and phenylamino.

In formulae (D-3) to (D-6), the arylene group represented by $\phi^1$ to $\phi^4$ is preferably an arylene group having from 6 to 20 carbon atoms, more preferably an arylene group having from 6 to 10 carbon atoms such as phenylene, naphthylene, and anthrathenylene, and most preferably a phenylene group. In addition, they may have a condensed ring, and a benzene ring is preferred as the condensed ring.

In formulae (D-3) to (D-6), the hetero atom contained in the heteroarylene group represented by $\phi^1$ to $\phi^4$ is preferably a nitrogen atom, an oxygen atom and a sulfur atom, the number of the hetero atom is preferably from 1 to 3, more preferably 1 or 2, the number of the carbon atom is preferably from 2 to 8, more preferably from 3 to 5, the number of the ring member is preferably 5 or 6, they may have a condensed ring, and a benzene ring is preferred as the condensed ring. Specific examples of the heteroarylene groups represented by $\phi^1$ to $\phi^4$ include the following (HA-1) to (HA-24), and particularly preferred of them are (HA-1), (HA-2), (HA-6), (HA-22) and (HA-23).

(HA-1)

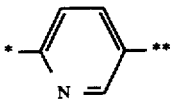

(HA-2)

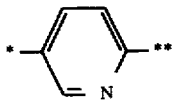

(HA-3)

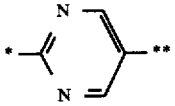

(HA-4)

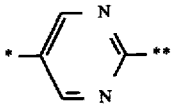

(HA-5)

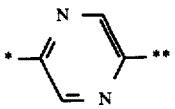

-continued (HA-6)

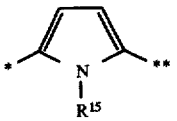

(HA-7)

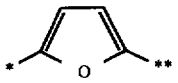

(HA-8)

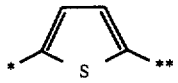

(HA-9)

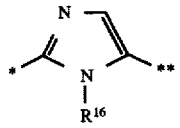

(HA-10)

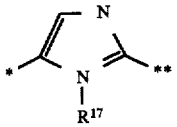

(HA-11)

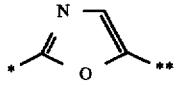

(HA-12)

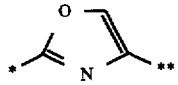

(HA-13)

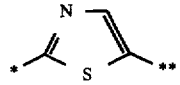

(HA-14)

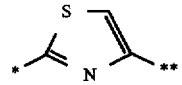

(HA-15)

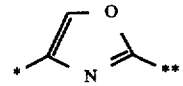

(HA-16)

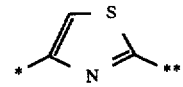

(HA-17)

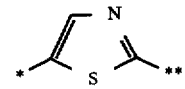

(HA-18)

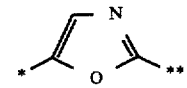

(HA-19)

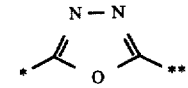

(HA-20)

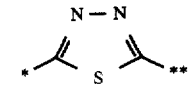

-continued (HA-21)

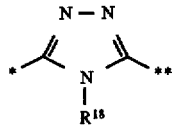

(HA-22)

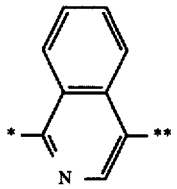

(HA-23)

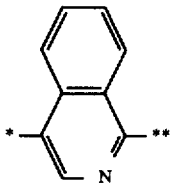

(HA-24)

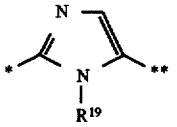

In formulae (HA-1) to (HA-24), * indicates the bonding position with NH in formulae (D-3) to (D-6), ** indicates the bonding position with $NR^2R^3$, OH or $NR^6R^7$, $R^{15}$ to $R^{19}$ represent an alkyl group or an aryl group, and these alkyl and aryl groups have the same meaning as the alkyl and aryl groups represented by $R^1$ to $R^{14}$ in formulae (D-3) to (D-10).

In formulae (D-9) and (D-10), the hydrocarbon ring group or a heterocyclic group bonded to a nitrogen atom by a double bond represented by $\phi^5$ and $\phi^6$ is preferably a 5- to 7-membered hydrocarbon ring group or heterocyclic group, the preferred hetero atom is nitrogen, oxygen, and sulfur, the number of the hetero atom contained is preferably from 0 to 3, more preferably from 0 to 2, the number of the carbon atom is preferably from 2 to 8, more preferably from 3 to 6, and particularly preferred of them is a 5- or 6-membered nitrogen-containing unsaturated heterocyclic ring. It is preferred that the carbon atoms in the rings of these hydrocarbon ring and heterocyclic ring in formulae (D-9) and (D-10) form double bonds with $R^{13}SO_2NHN$ or $R^{14}CONHN$, and they may have a condensed ring, and a benzene ring is preferred as the condensed ring. Examples of the hydrocarbon ring group or a heterocyclic group bonded to a nitrogen atom by a double bond represented by $\phi^5$ and $\phi^6$ include the following (CH-1) to (CH-18), and preferred of them are (CH-5), (CH-6), (CH-9), (CH-10), (CH-11), (CH-15) and (CH-17).

(CH-1)

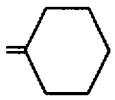

(CH-2)

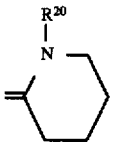

-continued (CH-3)

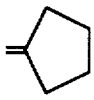

(CH-4)

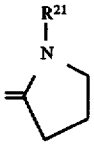

(CH-5)

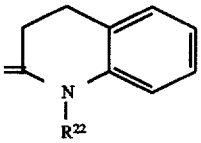

(CH-6)

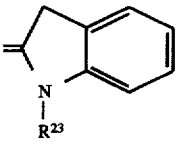

(CH-7)

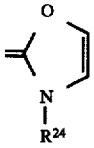

(CH-8)

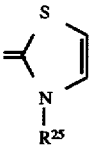

(CH-9)

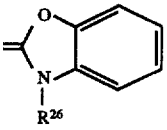

(CH-10)

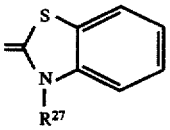

(CH-11)

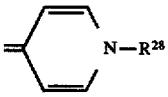

(CH-12)

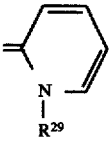

(CH-13)

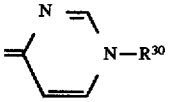

-continued (CH-14)

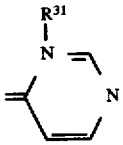

(CH-15)

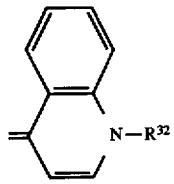

(CH-16)

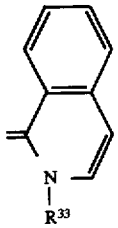

(CH-17)

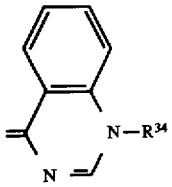

(CH-18)

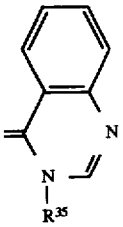

In formulae (CH-1) to (CH-18), $R^{21}$ to $R^{35}$ represent an alkyl group or an aryl group, and these alkyl and aryl groups have the same meaning as the alkyl and aryl groups represented by $R^1$ to $R^{14}$ in formulae (D-3) to (D-10).

In formulae (D-3) and (D-5), $R^2$ and $R^3$, $\phi^1$ and $R^2$, $\phi^1$ and $R^3$, $R^6$ and $R^7$, $\phi^3$ and $R^6$, $\phi^3$ and $R^7$ may be linked to form a ring, and the number of the ring member is preferably 5 or 6, a hetero atom may be contained as an atom constituting the ring, and an oxygen atom is preferred as the hetero atom.

The preferred range of the developing agent represented by formulae (D-3) to (D-10) is described in detail below.

In formulae (D-3), (D-4), (D-7) and (D-9), $R^1$, $R^4$, $R^9$ and $R^{13}$ preferably represent a phenyl group, and the preferred substituents therefor include a halogen atom (fluorine, chlorine, bromine), an alkyl group (having from 1 to 22 carbon atoms), an acyl group (having from 1 to 18 carbon atoms), a sulfonyl group (having from 1 to 18 carbon atoms), an alkoxy group (having from 1 to 22 carbon atoms), an alkoxycarbonyl group (having from 2 to 23 carbon atoms), a carbamoyl group (having from 2 to 23 carbon atoms), a sulfamoyl group (having from 1 to 22 carbon atoms), an acylamino group (having from 1 to 22 carbon atoms), a sulfonylamino group (having from 1 to 22 carbon atoms), a cyano group, and a nitro group.

In formulae (D-3) and (D-5), $R^2$, $R^3$, $R^6$ and $R^7$ preferably represent an alkyl group having from 1 to 8 carbon atoms, and the preferred substituents therefor include a hydroxyl group, an alkoxy group (having from 1 to 12 carbon atoms), an acylamino group (having from 1 to 12 carbon atoms), and a sulfonylamino group (having from 1 to 12 carbon atoms).

in formulae (D-5), (D-6), (D-8) and (D-10), $R^5$, $R^8$, $R^{11}$ and $R^{14}$ preferably represent an alkyl group having from 1 to 22 carbon atoms, an alkoxy group having from 1 to 22 carbon atoms, or a phenyl group. When $R^5$, $R^8$, $R^{11}$ and $R^{14}$ represent an alkyl group, the preferred substituents include a halogen atom (fluorine, chlorine, bromine), an acyl group (having from 1 to 18 carbon atoms), a sulfonyl group (having from 1 to 18 carbon atoms), a carbamoyl group (having from 2 to 23 carbon atoms), a sulfamoyl group (having from 1 to 22 carbon atoms), and a cyano group. When $R^5$, $R^8$, $R^{11}$ and $R^{14}$ represent an alkoxy group, the preferred substituents include a halogen atom (fluorine, chlorine, bromine), an aryl group (particularly preferably phenyl), an acyl group (having from 1 to 18 carbon atoms), a sulfonyl group (having from 1 to 18 carbon atoms), a carbamoyl group (having from 2 to 23 carbon atoms), a sulfamoyl group (having from 1 to 22 carbon atoms), a cyano group, and a nitro group. When $R^5$, $R^8$, $R^{11}$ and $R^{14}$ represent a phenyl group, the preferred substituents include a halogen atom (fluorine, chlorine, bromine), an alkyl group (having from 1 to 22 carbon atoms), an acyl group (having from 1 to 18 carbon atoms), a sulfonyl group (having from 1 to 18 carbon atoms), an alkoxy group (having from 1 to 22 carbon atoms), an alkoxycarbonyl group (having from 2 to 23 carbon atoms), a carbamoyl group (having from 2 to 23 carbon atoms), a sulfamoyl group (having from 1 to 22 carbon atoms), an acylamino group (having from 1 to 22 carbon atoms), a sulfonylamino group (having from 1 to 22 carbon atoms), a cyano group and a nitro group.

In formulae (D-7) and (D-8), $R^{10}$ and $R^{12}$ preferably represent an aryl group or a heterocyclic group. When $R^{10}$ and $R^{12}$ represent an aryl group, particularly preferred is a phenyl group. When $R^{10}$ and $R^{12}$ represent a heterocyclic group, particularly preferred is a 6-membered nitrogen-containing heteroaryl group, and the number of the nitrogen atom contained in the ring in this case is preferably 1 or 2. An electron attractive group is preferred as the substituent for $R^{10}$ and $R^{12}$, and particularly preferred substituents include a halogen atom (fluorine, chlorine, bromine), a halogenoalkyl group (trifluoromethyl, trichloromethyl), an acyl group (having from 1 to 18 carbon atoms), a sulfonyl group (having from 1 to 18 carbon atoms), an alkoxycarbonyl group (having from 2 to 23 carbon atoms), a carbamoyl group (having from 2 to 23 carbon atoms), a sulfamoyl group (having from 1 to 22 carbon atoms), a cyano group and a nitro group.

In formulae (D-3) to (D-6), $\phi^1$ to $\phi^4$ preferably represent a phenylene group, and the preferred substituents therefor include a halogen atom (fluorine, chlorine, bromine), an alkyl group (having from 1 to 22 carbon atoms), an alkoxy group (having from 1 to 22 carbon atoms), an acyl group (having from 1 to 18 carbon atoms), a sulfonyl group (having from 1 to 18 carbon atoms), an alkoxycarbonyl group (having from 2 to 23 carbon atoms), a carbamoyl group (having from 2 to 23 carbon atoms), a sulfamoyl group (having from 1 to 22 carbon atoms), an acylamino group (having from 1 to 22 carbon atoms), a sulfonylamino group (having from 1 to 22 carbon atoms), and a cyano group.

In formulae (D-9) and (D-10), $\phi^5$ and $\phi^6$ preferably represent a 5- or 6-membered nitrogen-containing heterocyclic group bonded to a nitrogen atom by a double bond, the number of the nitrogen atom contained is preferably 1 or 2, a sulfur atom is preferred as the hetero atom other than the nitrogen atom, and the number of the sulfur atom contained in the ring in this case is preferably 1. $\phi^5$ and $\phi^6$ particularly preferably represent (CH-10), (CH-11), (CH-15) and (CH-17).
Specific examples of the developing agent for use in the present invention are shown below, but the present invention is not limited thereto.
(1)
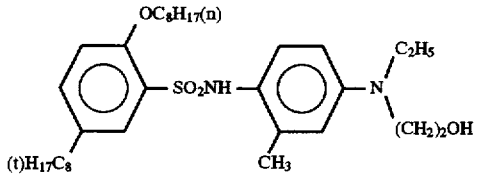
(2)
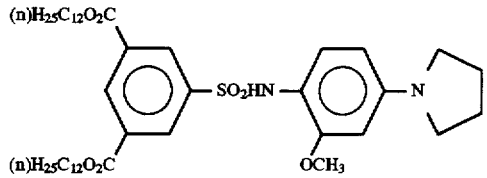
(3)
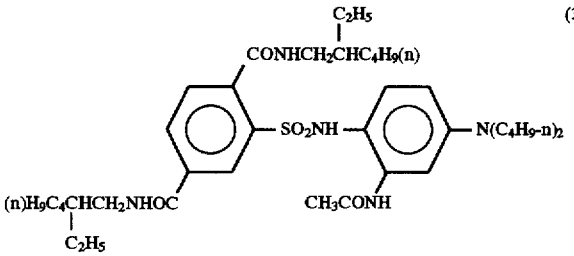
(4)
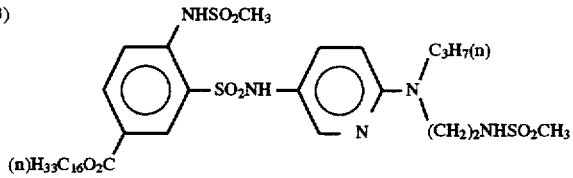
(5)
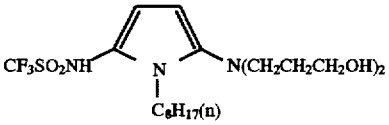
(6)
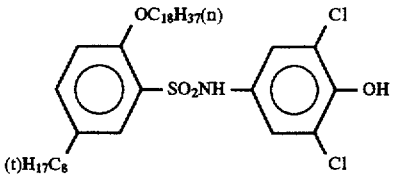
(7)
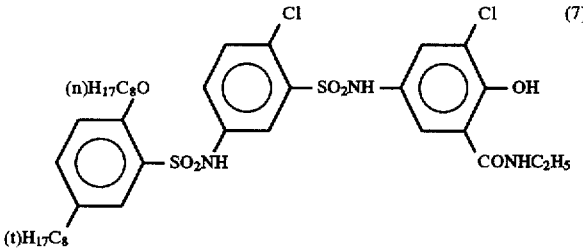
(8)
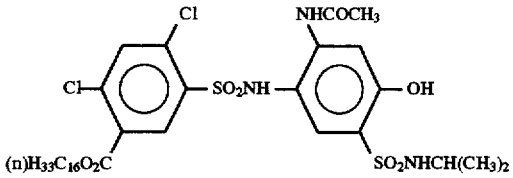
(9)
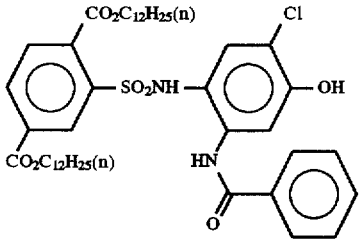
(10)
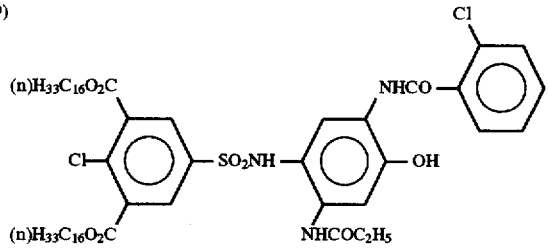
(11)
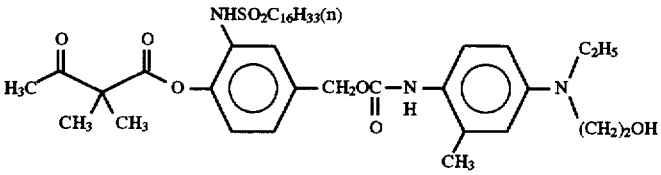
(12)
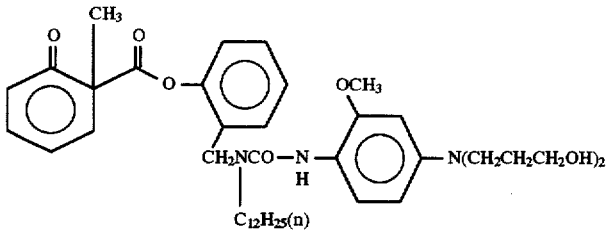

-continued
(13)
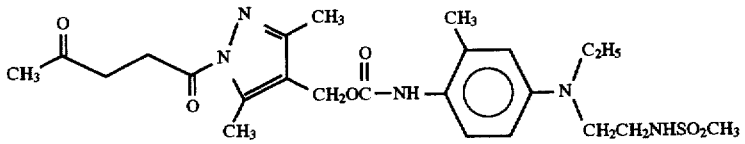
(14)
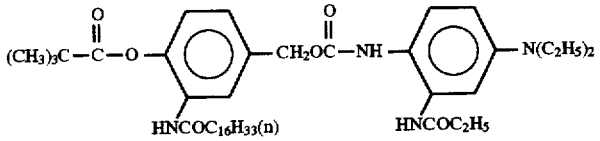
(15)
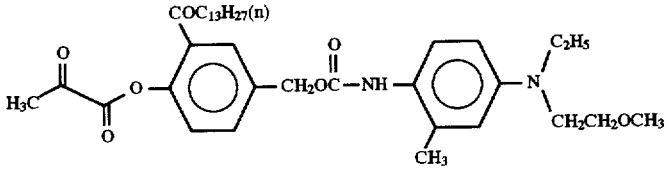
(16)
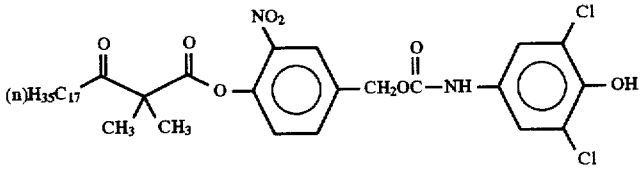
(17)
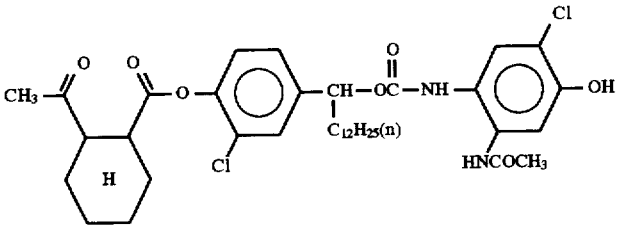
(18)
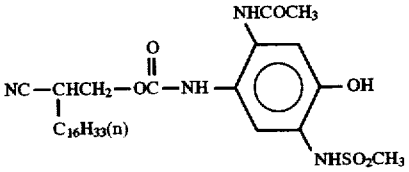
(19)
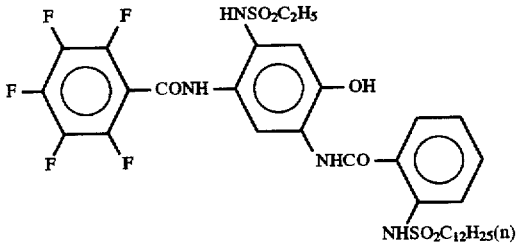
(20)
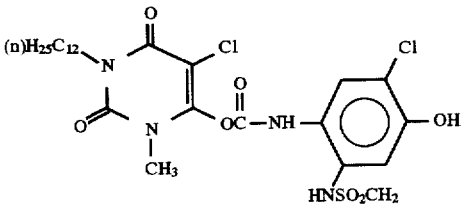
(21)
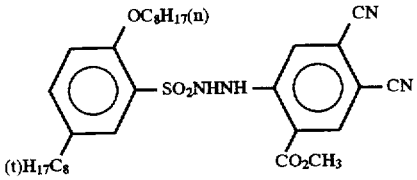
(22)
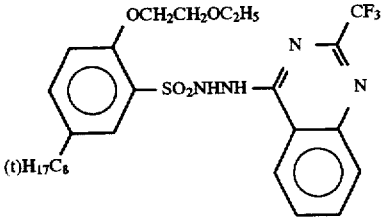
(23)
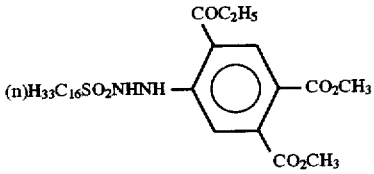

-continued
(24)
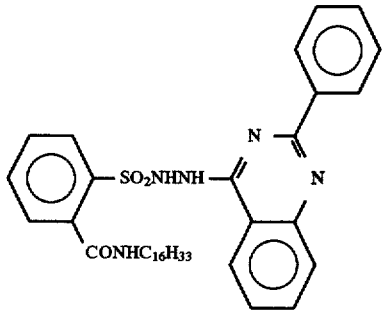
(25)
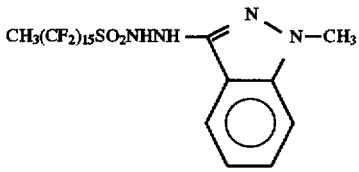
(26)
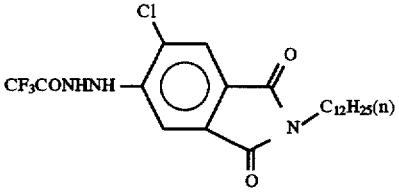
(27)
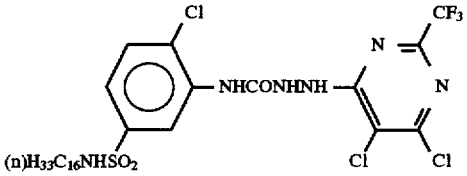
(28)
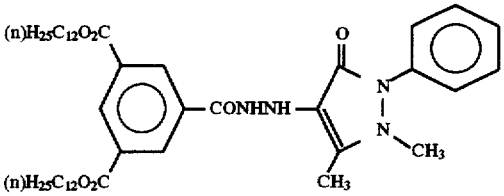
(29)
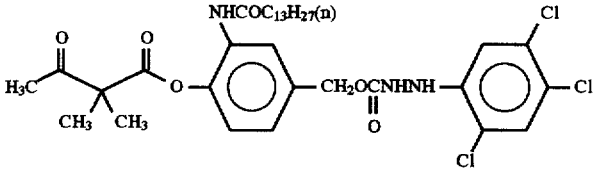
(30)
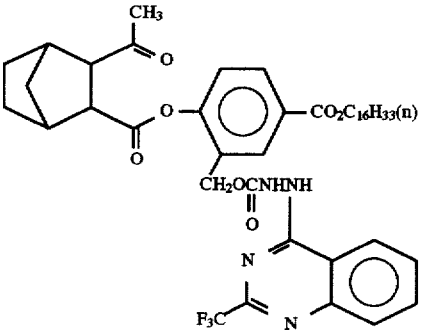
(31)
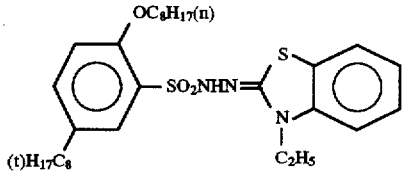
(32)
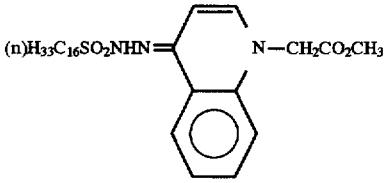
(33)
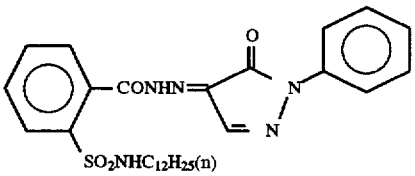
(34)
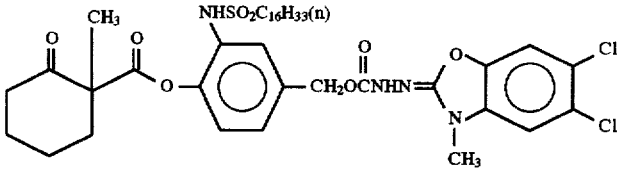

-continued (35)

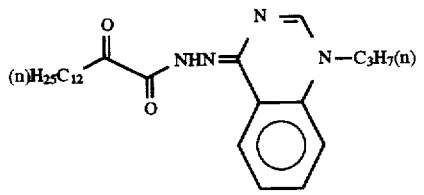

(36)

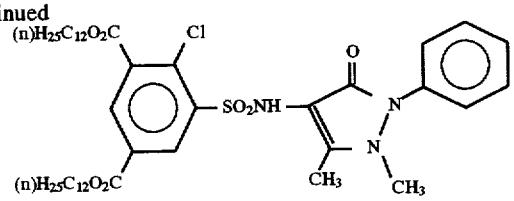

(37)

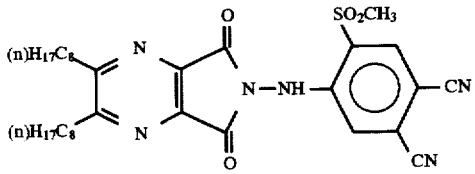

(38)

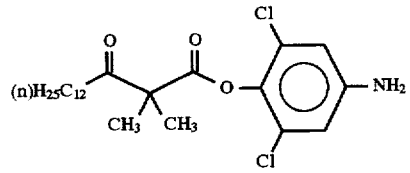

(39)

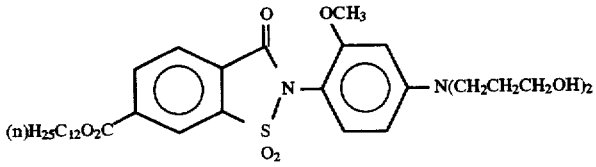

(40)

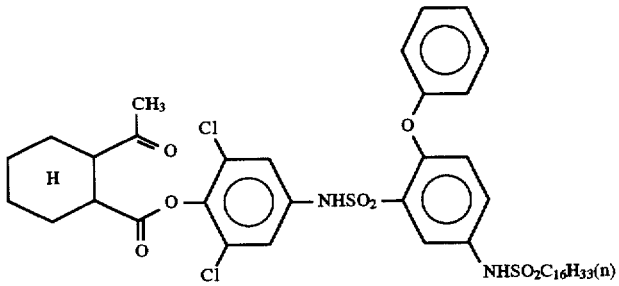

The synthesis examples of the developing agents for use in the present invention are described below. Other developing agents can also be synthesized by the similar methods.

SYNTHESIS EXAMPLE 1

Synthesis of Developing Agent (1)

Developing agent (1) was synthesized according to the following synthesis scheme.

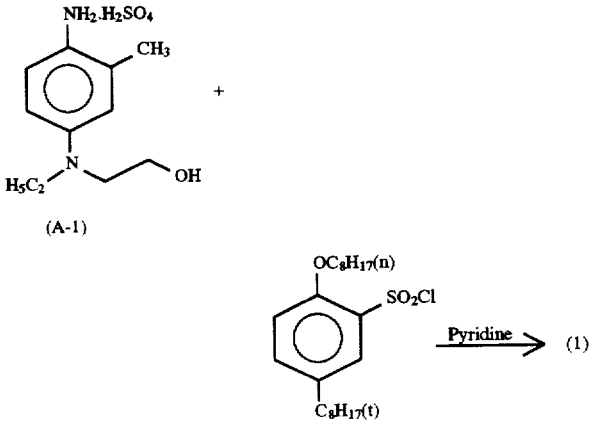

20 g of Compound (A-1) and 20 ml of pyridine were dissolved in 100 ml of a distilled water, and a solution of 29 g of Compound (A-2) dissolved in 100 ml of ethyl acetate was dropwise added thereto over 30 minutes while stirring at room temperature. The reaction mixture was further stirred at room temperature for 1 hour, then an organic phase was separated and washed with dilute hydrochloric acid and water and dried over magnesium sulfate. The desiccant was filtered off, the solvent was distilled off, and the obtained brown oily product was subjected to purification through a silica gel column chromatography to obtain 32 g of the objective Developing Agent (1) as a pale yellow vitreous solid.

SYNTHESIS EXAMPLE 2

Synthesis of Developing Agent (6)

Developing agent (6) was synthesized according to the following synthesis scheme.

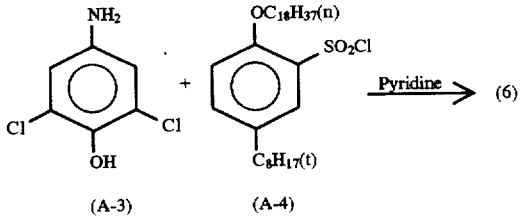

30 g of Compound (A-3) and 30 ml of pyridine were dissolved in 150 ml of N,N-dimethylformamide, and a solution of 94 g of Compound (A-4) dissolved in 100 ml of ethyl acetate was dropwise added thereto over 40 minutes while stirring at room temperature. The reaction mixture was further stirred at room temperature for 2 hours, then poured into water, and extracted with ethyl acetate. An organic phase was separated and washed with dilute hydrochloric acid and water and dried over magnesium sulfate. The desiccant was filtered off, the solvent was distilled off, and the obtained brown oily product was subjected to purification through a silica gel column chromatography to obtain 115 g of the objective Developing Agent (6) as a colorless vitreous solid.

SYNTHESIS EXAMPLE 3

Synthesis of Developing Agent (22)

Developing agent (22) was synthesized according to the following synthesis scheme.

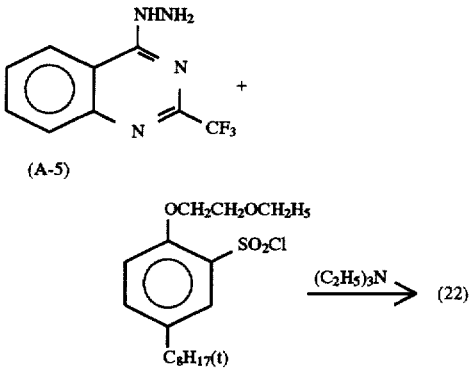

30 g of Compound (A-5) and 20 ml of triethylamine were dissolved in 150 ml of N,N-dimethylformamide, and a solution of 54 g of Compound (A-6) dissolved in 40 ml of tetrahydrofuran was dropwise added thereto over 100 minutes while stirring at room temperature. The reaction mixture was further stirred at room temperature for 2 hours, then poured into water, and extracted with ethyl acetate. An organic phase was separated and washed with dilute hydrochloric acid and water and dried over magnesium sulfate. The desiccant was filtered off, the solvent was distilled off to obtain a yellow oily product. The oily product was crystallized from the mixed solvent of n-hexane/ethyl acetate to obtain 42 g of the objective Developing Agent (22) as colorless crystals. Melting point: 96°–100° C.

The amount of the developing agent to be incorporated in a photographic material is preferably from 0.5 to 40 mol %, more preferably from 0.5 to 30 mol %, and most preferably from 1 to 20 mol %, based on the light-sensitive silver halide.

Known dispersion methods can be used for incorporation of the developing agent as well as couplers described later. The developing agent can be incorporated into either a light-insensitive layer or a light-sensitive emulsion layer, but is preferably incorporated into a light-sensitive emulsion layer.

The total film thickness of the hydrophilic colloid layers on the emulsion layer side of the silver halide color photographic material of the present invention is preferably 17 μm or less, more preferably 15 μm or less.

The tabular grains of the present invention can be doped with an ion of metal such as group VIII metals, In, Cd, Zn, Tl, Pb, Bi, Hg, Cu, Cr, Mo and Re. Preferred metal ions to be doped are ions of Pb, Fe, Cr, Rh, Ir and Ru.

It is preferred that the silver halide emulsion is subjected to gold sensitization and selenium sensitization.

The selenium compounds disclosed in the patents conventionally well-known can be used as a selenium sensitizer in the present invention. That is, an unstable type selenium compound and/or a non-unstable type selenium compound are usually added and used by stirring an emulsion at a high temperature of preferably 40° C. or more for a certain period of time. The compounds disclosed in JP-B-44-15748, JP-B-43-13489, JP-A-4-25832 and JP-A-4-109240 are preferably used as the unstable selenium compounds. Specific examples of the unstable selenium sensitizers include isoselenocyanates (e.g., aliphatic isoselenocyanates such as allyl isoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl) selenide), selenophosphates, phosphine-selenides, and colloidal metal selenium.

The preferred types of the unstable selenium compounds are described above but they are not limitative. In the unstable type selenium compound as the sensitizer for a photographic emulsion, the structure of the compound is not important as long as the selenium is unstable. It is generally understood that an organic moiety of a selenium sensitizer molecule has no role except for carrying selenium and allowing it to be present in an emulsion in an unstable form. The unstable selenium compounds having such a broad idea are advantageously used in the present invention.

The compounds disclosed in JP-B-46-4553, JP-B-52-34492 and JP-B-52-34491 are used as the non-unstable selenium compound in the present invention. Examples of the non-unstable selenium compounds include, for example, selenious acid, potassium selenocyanide, selenazoles, quaternary salts of selenazoles, diaryl selenide, diaryl diselenide, dialkyl selenide, dialkyl diselenide, 2-selenazolidinedione, 2-selenoxazolidinethione, and derivatives thereof.

The selenium sensitization method is disclosed in the following patents and literature: U.S. Pat. Nos. 1,574,944, 1,602,592, 1,623,499, 3,297,446, 3,297,447, 3,320,069, 3,408,196, 3,408,197, 3,442,653, 3,420,670, 3,591,385, French Patents 2,693,038, 2,093,209, JP-B-52-34491, JP-B-52-34492, JP-B53-295, JP-B-57-22090, JP-A-59-180536, JP-A-59-185330, JP-A-59-181337, JP-A-59-187338, JP-A-59-192241, JP-A-60-150046, JP-A60-151637, JP-A-61-246738, JP-A-3-4221, JP-A-3-148648, JP-A-3-111838, JP-A-3-116132, JP-A-3-237450, JP-A-4-25832, JP-A-4-32831, JP-A-4-109240, Japanese Patent Application No. 2-110558, British Patents 255,846, 861,984, and H. E. Spencer et al., *Journal of Photographic Science*, Vol. 31, pages 158 to 169 (1983).

The silver halide photographic emulsion of the present invention can achieve higher sensitivity and lower fog by the combined use with sulfur sensitization and/or gold sensitization in the chemical sensitization. Particularly, in the silver halide emulsion of the present invention, it is the most preferred mode to carry out the gold sensitization and the sulfur sensitization in combination with the selenium sensitization.

The sulfur sensitization is usually carried out by adding a sulfur sensitizer and stirring an emulsion at a high temperature, preferably 40° C. or more, for a certain period of time.

The gold sensitization is usually carried out by adding a gold sensitizer and stirring an emulsion at a high temperature, preferably 40° C or more, for a certain period of time.

Conventionally known sensitizers can be used as sulfur sensitizers for the above sulfur sensitization. They include, for example, thiosulfate, thioureas, allyl isothiacyanate, cystine, p-toluenesulfonate, and rhodanine. In addition thereto, the sulfur sensitizers described in U.S. Pat. Nos. 1,574,944, 2,410,689, 2,278,947, 2,728,668, 3,501,313, and 3,656,955, German Patent 1,422,869, JP-B-56-24937 and JP-A-55-45016 can also be used. The addition amount of the sulfur sensitizers may be an amount which is sufficient for effectively increasing the sensitivity of an emulsion. This amount is varied over a considerably wide range under various conditions such as pH, temperature and a size of a silver halide grain, but is preferably from $1\times10^{-7}$ mol to $5\times10^{-4}$ mol per mol of the silver halide.

The oxidation number of the gold in the gold sensitizer for the above gold sensitization may be either +1 valent or +3 valent, and gold compounds which are usually used as the gold sensitizer can be used. The representative examples thereof include chloroaurate, potassium chloroaurate, auric trichloride, potassium auric thiocyanate, potassium iodoaurate, tetracyanoauric acid, ammonium aurothiocyanate, and pyridyl trichlorogold.

The addition amount of the gold sensitizer is varied according to various conditions, and the standard therefor is preferably from $1\times10^{-7}$ mol to $5\times10^{-4}$ mol per mol of the silver halide.

In a chemical ripening, no limit is required to put on the addition time and the addition order of a silver halide solvent, the selenium sensitizer, and the sulfur sensitizer and/or the gold sensitizer which can be used in combination with the selenium sensitizer, and the above compounds can be added at the same time or at a different addition time, for example, at an initial stage of the chemical ripening (preferably) or during the chemical ripening. The above compounds may be added by dissolving in water or a single solution or a mixed solution of an organic solvent which is miscible with water, for example, methanol, ethanol and acetone.

The light-sensitive material of the present invention can comprise at least one blue-sensitive layer, at least one green-sensitive layer and at least one red-sensitive layer on a support. The number of silver halide emulsion layers and light-insensitive layers and the order of the arrangement of the layers are not specifically limited. In a typical embodiment, the silver halide photographic material of the present invention comprises at least one light-sensitive layer consisting of a plurality of silver halide emulsion layers having substantially the same color sensitivity but different degrees of sensitivity on a support. The light-sensitive layer is a unit light-sensitive layer having a color sensitivity to any of blue light, green light and red light. In the multilayer silver halide color photographic material, these unit light-sensitive layers are generally arranged in the order of red-sensitive layer, green-sensitive layer and blue-sensitive layer from the support side. However, the order of arrangement can be reversed depending on the purpose, alternatively, the light-sensitive layers may be arranged in such a way that a layer having a different color sensitivity is interposed between layers having the same color sensitivity.

Light-insensitive layers such as various interlayers may be provided between the above-described silver halide light-sensitive layers, and as an uppermost layer or a lowermost layer.

These interlayers can contain couplers and DIR compounds as described in JP-A-61-43748, JP-A-59-113438, JP-A-59-113440, JP-A-61-20037 and JP-A-61-20038, and they can further contain a color mixing preventive as generally used.

As the plurality of silver halide emulsion layers constituting each unit light-sensitive layer, a two-layer structure of a high sensitivity emulsion layer and a low sensitivity emulsion layer can be preferably used as disclosed in West German Patent 1,121,470 and British Patent 923,045. It is usually preferred that the emulsion layers are arranged so as to decrease in sensitivity toward a support in turn. Further, a light-insensitive layer can be provided between these silver halide emulsion layers. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivity, the layers in the unit layer of the same color sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer.

Moreover, the arrangement may be varied as indicated above in the case where there are four or more layers.

As described above, various layer structures and arrangements can be selected depending on the purpose of the light-sensitive material.

The silver halide grains in the photographic emulsion other than the silver halide of the present invention may have a regular crystal form such as a cubic, octahedral or tetradecahedral form, an irregular crystal form such as a spherical or plate form, a form which has crystal defects such as twin crystal planes, or a form which is a composite of these forms.

The silver halide grains other than the silver halide of the present invention may be a fine grain having a projected area diameter of about 0.2 μm or less or a large grain having a projected area diameter of up to about 10 μm, and the emulsion may be polydispersed or monodispersed.

The silver halide emulsions for use in the present invention have been usually subjected to physical ripening, chemical ripening and spectral sensitization.

There are cases that a method in which the chalcogen compounds as disclosed in U.S. Pat. No. 3,772,031 are added during the emulsion formation is useful. Cyanide, thiocyanide, selenocyanic acid, carbonate, phosphate and acetate can be present in addition to S, Se and Te.

The silver halide grains for use in the present invention can be subjected to at least one of sulfur sensitization, selenium sensitization, gold sensitization, palladium sensitization, other noble metal sensitization and reduction sensitization at an arbitrary stage during silver halide emulsion formation. As described above, a combined use of gold sensitization, sulfur sensitization and selenium sensitization is most preferred. Various types of emulsions can be prepared depending upon the stages when the chemical sensitization is carried out. There are a type in which a chemically sensitized nucleus is buried in the internal part of a grain, a type in which a chemically sensitized nucleus is buried in the shallow part from the surface of a grain, or a type in which a chemically sensitized nucleus is formed on the surface of a grain. The emulsion of the present invention can select the place of a chemically sensitized nucleus according to the purpose, but it is generally preferred to have at least one chemically sensitized nucleus in the vicinity of the surface of a grain.

The silver halide emulsion for use in the present invention is preferably reduction sensitized during grain formation, after grain formation and before chemical sensitization or during chemical sensitization, or after chemical sensitization.

The method of the reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, ascorbic acid and derivatives thereof, amines and polyamines, hydrazine derivatives, formamidine-sulfinic acid, silane compounds and borane compounds are well known as a reduction sensitizer. These known reduction sensitizers can be selected and used in the present invention, and two or more of these compounds can also be used in combination. Stannous chloride, thiourea dioxide, dimethylamineborane, ascorbic acid and derivatives thereof are preferred compounds as a reduction sensitizer. As the addition amount of the reduction sensitizer depends upon the production conditions of the emulsion, the addition amount needs to be selected, but $10^{-7}$ to $10^{-3}$ mol per mol of the silver halide is preferred.

The reduction sensitizers are dissolved in water or a solvent such as alcohols, glycols, ketones, esters or amides and added during grain growth. They may be previously added to a reaction vessel but is more preferably added at an appropriate stage during grain growth. Further, the reduction sensitizers have been previously added to an aqueous solution of water-soluble silver salt or an aqueous solution of water-soluble alkali halide and silver halide grains can be precipitated using these aqueous solutions. In addition, the solution of the reduction sensitizers may be divided to several parts and added in several times or may be added continuously over a long period of time with the degree of the grain growth.

It is preferred to use an oxidizing agent for silver during the production process of the emulsion of the present invention. An oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form slightly water-soluble silver salt such as silver halide, silver sulfide or silver selenide, or may form easily water-soluble silver salt such as silver nitrate. An oxidizing agent for silver may be inorganic or organic. Examples of inorganic oxidizing agents include oxyacid salt, such as ozone, hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), halogen element such as iodine and bromine, perhalogen acid salt (e.g., potassium periodate), salt of metal of high valency (e.g., potassium hexacyanoferrate(III)), and thiosulfonate.

Further, examples of organic oxidizing agents include quinones such as p-quinone, organic peroxide such as peracetic acid and perbenzoic acid, a compound which releases active halogen (e.g., N-bromosuccinimide, chloramine T, chloramine B).

The oxidizing agents which are preferably used in the present invention are inorganic oxidizing agents such as ozone, hydrogen peroxide and addition products thereof, halogen element, thiosulfonate, and organic oxidizing agents such as quinones. It is preferred to use the above described reduction sensitization in combination with an oxidizing agent for silver. The method of usage can be selected from a method in which an oxidizing agent is used and then reduction sensitization is carried out, an inverse method thereof, or a method in which both are concurred with. These methods can be used either in grain formation process or in chemical sensitization process selectively.

The silver halide light-sensitive material of the present invention is a material having two or more light-sensitive layers of different spectral sensitivities, and these spectral sensitivities are not limited to blue sensitivity, green sensitivity and red sensitivity.

The silver halide emulsion has been generally subjected to physical ripening, chemical ripening and spectral sensitization and used. The additives which are used in these processes are disclosed in *Research Disclosure*, No. 17643, No. 18716 and No. 307105 the locations related thereto are indicated in the table below.

| Type of Additives | RD 17643 (Dec., 1978) | RD 18716 (Nov., 1979) | RD 307105 (Nov., 1989) |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Whitening Agents | page 24 | page 647, right column | page 868 |
| 5. Antifoggants and Stabilizers | pages 24–25 | page 649, right column | pages 868–870 |
| 6. Light Absorbing Agents, Filter Dyes, and Ultraviolet Absorbing Agents | pages 25–26 | page 649, right column to page 650, left column | page 873 |
| 7. Antistaining Agents | page 25, right column | page 650, left to right columns | page 872 |
| 8. Dye image Stabilizers | page 25 | page 650, left column | page 872 |
| 9. Hardening Agents | page 26 | page 651, left column | pages 874–875 |
| 10. Binders | page 26 | page 651, left column | pages 873–874 |
| 11. Plasticizers and Lubricants | page 27 | page 650, right column | page 876 |
| 12. Coating Aids and Surfactants | pages 26–27 | page 650, right column | pages 875–876 |
| 13. Antistatic Agents | page 27 | page 650, right column | pages 876–877 |
| 14. Matting Agents | — | — | pages 878–879 |

Other techniques and inorganic and organic materials which can be used in the present invention are disclosed in the following places of EP 436938 A2 and the patents cited in the following places.

1. Layer Structure line 34, page 146 to line 25, page 147

2. Yellow Coupler line 35, page 137 to line 33, page 146, lines 21 to 23, page 149

3. Magenta Coupler lines 24 to 28, page 149; line 5, page 3 to line 55, page 25 of EP 421453 A 4. Cyan Coupler lines 29 to 33, page 149; line 28, page 3 to line 2, page 40 of EP 432804 A 5. Polymer Coupler lines 34 to 38, page 149; line 39, page 113 to line 37, page 123 of EP 435334 A 6. Colored Coupler line 42, page 53 to line 34, page 137, lines 39 to 45, page 149

7. Other Functional Coupler line 1, page 7 to line 41, page 53, line 46, page 149 to line 3 page 150; line 1, page 3 to line 50, page 29 of EP 435334 A 8. Preservative, Antibacterial Agent lines 25 to 28, page 150

9. Formalin Scavenger lines 15 to 17, page 149

10. Other Additives lines 38 to 47, page 153; line 21, page 75 to line 56, page 84 of EP 421453 A, line 40, page 27 to line 40, page 37

11. Dispersion Method lines 4 to 24, page 150

12. Support Physical Properties of Film line 32 to 34, page 150

13. Film Thickness, lines 35 to 49, page 150

14. Desilvering Process line 48, page 151 to line 53, page 152

15. Automatic Processor line 54, page 152 to line 2, page 153

16. Washing and Stabilizing Process lines 3 to 37, page 153

Various processing solutions which are used in the present invention are described in detail below.

An alkali agent for starting the development is essential in the developing solution (as the case that the developing agent is not added is possible, hereinafter referred to as activator) which is used for the light-sensitive material of the present invention. A solution having a buffering ability with pH from 8 to 13, preferably from 9 to 12, is preferred.

Preferred buffering agents which can be used for maintaining the above range of pH include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt, and lysine salt. The use of carbonate or phosphate is particularly preferred.

The addition amount of the buffering agent to the activator is preferably 0.1 mol/liter or more and more preferably from 0.1 mol/liter to 0.4 mol/liter.

The activator for use in the present invention can contain hydroxylamine or sulfite ion as an antioxidant for the developing agent eluted out, and it is preferred that the activator further contains other organic preservatives.

The organic preservative as used herein indicates an organic compound capable of reducing the deterioration rate of an aromatic primary amine color developing agent when it is added into the processing solution for a color photographic material. That is, the organic preservative is an organic compound having a function of preventing the oxidation of the color developing agent by air and the like, and preferred examples thereof include hydroxylamine derivatives, hydroxamic acids, hydrazines, hydrazides, phenols, α-hydroxyketones, α-aminoketones, sugars, monoamines, diamines, polyamines, tertiary ammonium salts, nitroxy radicals, alcohols, oximes, diamide compounds, condensed amines are particularly effective organic preservatives. In particular, the addition of alkanolamines such as triethanolamine, dialkylhydroxylamine such as N,N-diethylhydroxylamine and N,N-di(sulfoethyl)-hydroxylamine, hydrazine derivatives (exclusive of hydrazine) such as N,N-bis(carboxymethyl)hydrazine, or aromatic polyhydroxy compounds such as sodium catechol-3,5-disulfonate is preferred.

Further, it is preferred mode that the above preservatives act as nucleophilic agents in the activator processing solution, and accelerate the elimination of the color developing agent from the photographic material.

The activator for use in the present invention can contain arbitrary antifoggants, if necessary. Alkali metal halides such as sodium chloride, potassium bromide and potassium iodide, and organic antifoggants can be used as such an antifoggant. Examples of the organic antifoggant include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine. Particularly, the presence of the chloride or bromide is preferred, and the preferred addition amount of the chloride is from 0.01 mol to 0.5 mol/liter, and that of the bromide is from 0.0001 mol to 0.01 mol/liter. They can be designed such that the above concentration is maintained by elution from the light-sensitive material during the continuous processing.

In addition, various chelating agents can be contained in the activator to prevent the precipitation of calcium and magnesium, or to improve the stability of the activator. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)-ethylenediamine-N,N'-diacetic acid, and hydroxyethyliminodiacetic acid. These chelating agents may be used in combination of two or more thereof.

The chelating agent can be added in an amount necessary for effectively blocking the metal ions in the activator, and the amount thereof is generally about 0.1 g to 10 g per liter.

The activator for use in the present invention can contain an arbitrary development accelerator, if necessary. Examples of the development accelerator include thioether based compounds disclosed in JP-B-37-16088, JP-B-37-5987, JP-B-38-7826, JP-B-44-12380, JP-B-45-9019 and U.S. Pat. No. 3,813,247, p-phenylenediamine based compounds disclosed in JP-A-52-49829 and JP-A-50-15554, quaternary ammonium salts disclosed in JP-A-50-137726, JP-B-44-30074, JP-A-56-156826 and JP-A-52-43429, amine based compounds disclosed in U.S. Pat. No. 2,494,903, 3,128,182, 4,230,796, 3,253,919, JP-B-41-11431, U.S. Pat. No. 2,482,546, 2,596,926 and 3,582,346, and polyalkylene oxides disclosed in JP-B-37-16088, JP-B-42-25201, U.S. Pat. No. 3,128,183, JP-B-41-11431, JP-B-42-23883 and U.S. Pat. No. 3,532,501, in addition to the above compounds, 1-phenyl-3-pyrazolidones and imidazoles.

In the present invention, an auxiliary developing agent precursor having the following structure can be incorporated into at least one layer of the photographic material, or may be added into the activator.

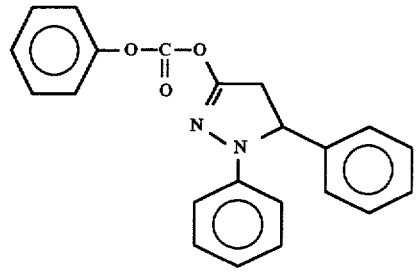

The color activators applicable to the present invention can contain a whitening agent. 4,4'-Diamino-2,2'-disulfostilbene based compounds are preferred as a whitening agent. The addition amount thereof is from 0 to 5 g/liter and preferably 0.1 to 4 g/liter.

It is not necessary essential for the activator of the present invention to contain a developing agent, but can contain the activator for the purpose of controlling photographic characteristics, if necessary. The developing agent is preferably an aromatic primary amine color developing agent such as p-phenylenediamine derivatives. Examples thereof include N,N-diethyl-p-phenylenediamine, 2-amino-5-diethylaminotoluene,2-amino-5-(N-ethyl-N-laurylamino) toluene, 3-methyl-4-[N-ethyl-N-(β-hydroxyethyl)amino] aniline,3-methyl-4-[N-ethyl-N-(δ-hydroxybutyl)amino] aniline, 2-methyl-4-[N-ethyl-N-(β-hydroxyethyl)amino] aniline, 4-amino-3-methyl-N-ethyl-N-[β-(methanesulfonamido)ethyl]aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. More preferred are 4-amino-3-methyl-N-ethyl-N-[β-(methanesulfonamido)ethyl]aniline, 3-methyl-4-[N-ethyl-N-(β-hydroxyethyl)amino]aniline, and 2-methyl-4-[N-methyl-N-(β-hydroxybutyl)amino]aniline. Of the above compounds,4-amino-3-methyl-N-ethyl-N-[β-(methanesulfonamido)-ethyl]aniline and 3-methyl-4-[N-ethyl-N-(β-hydroxyethyl)amino]aniline are particularly preferred.

Further, these p-phenylenediamine derivatives may be salts of sulfate, hydrochloride, sulfite, and p-toluenesulfonate.

The replenishment rate of the activator of the present invention is preferred as small as possible, and generally from 20 ml to 600 ml, and preferably from about 60 ml to 300 ml, per $m^2$ of the photographic material. The processing temperature of the activator is from 25° to 50° C., preferably from 30° to 45° C., and most preferably from 35° to 45° C.

The processing time is from 5 seconds to 2 minutes and preferably from 10 seconds to 1 minute, although there is no limitation.

A photographic emulsion layer is generally bleaching processed after being color development processed. A bleaching process and a fixing process may be carried out at the same time (bleach-fixing process) or may be performed separately. A processing method comprising carrying out a bleach-fixing process after a bleaching process can be adopted for further rapid processing. Also, processing in two successive bleach-fixing baths, fixing process before bleach-fixing process, or bleaching process after bleach-fixing process may be arbitrarily selected according to purposes. A bleach-fixing process is most preferably used in the present invention.

Examples of the bleaching agent include compounds of polyvalent metals such as iron(III), peracids, quinones, and nitro compounds. Preferred examples thereof include a bleaching agent such as organic complex salts of iron(III), e.g., ethylenediaminetetraacetic acid, diethylenetriaminepentaacetic acid, cyclohexanediaminetetraacetic acid, methyliminodiacetic acid, β-alaninediacetic acid, glycol ether diaminetetraacetic acid, and bleaching agents disclosed in JP-A-4-121739, page 4, right lower column to page 5, left upper column (e.g., 1,3-propylenediaminetetraacetic acid iron complex salt), a carbamoyl based bleaching agent disclosed in JP-A-4-73647, a bleaching agent having a heterocyclic ring disclosed in JP-A-4-174432, bleaching agents disclosed in EP 520457 A (e.g., N-(2-carboxyphenyl) iminodiacetic acid iron(III) complex salt), bleaching agents disclosed in JP-A-5-66527 (e.g., ethylenediamine-N-2-carboxyphenyl-N,N',N'-triacetic acid iron(III) complex salt), bleaching agents disclosed in EP 501479 A, bleaching agents disclosed in JP-A-4-127145, and aminopolycarboxylic acid iron(III) salts, or salts thereof disclosed in JP-A-3-144446, page 11.

Organic aminocarboxylic acid iron(III) complex salts are particularly useful in both a bleaching solution and a bleach-fixing solution. The pH of a bleaching solution or a bleach-fixing solution containing these organic aminocarboxylic acid iron(III) complex salts is generally from 4.0 to 8, however, processing can be carried out with the lower pH for accelerating the processing rate.

A bleaching process is preferably carried out immediately after color development, but in the case of a reversal process, a bleaching process is in general carried out via a compensating bath (it may be a bleaching accelerating bath). The compensating bath may contain an image stabilizing agent described later.

A desilvering processing bath which is used in the present invention can contain, in addition to a bleaching agent, a rehalogenating agent disclosed on page 12 of JP-A-3-144446, a pH buffering agent, known additives, aminopolycarboxylic acids, organic phosphonic acids, etc.

Further, a bleaching solution or a prebath thereof for use in the present invention can include various kinds of bleaching accelerators. Specific examples of the bleaching accelerator include compounds having a mercapto group or a disulfide group disclosed in U.S. Pat. No. 3,893,858, German Patent 1,290,821, British Patent 1,138,842, JP-A-53-95630, *Research Disclosure*, No. 17129 (July, 1978), thiazolidine derivatives disclosed in JP-A-50-140129, thiourea derivatives disclosed in U.S. Pat. No. 3,706,561, iodides disclosed in JP-A-58-16235, polyethylene oxides disclosed in German Patent 2,748,430, and polyamine compounds disclosed in JP-B-45-8836. In addition, compounds disclosed in U.S. Pat. No. 4,552,834 are preferably used. These bleaching accelerators may be added in photographic materials. These bleaching accelerators are in particular effective when bleach-fixing photographic materials for photographing. Especially preferred are mercapto compounds disclosed in British Patent 1,138,842 and JP-A-2-190856.

It is preferred to include organic acids in a bleaching solution and a bleach-fixing solution, in addition to the above compounds, for inhibiting bleaching stain. Particularly preferred organic acids are compounds having a acid dissociation constant (pKa) value of from 2 to 5.5, and dibasic acids are especially preferred. Specifically, preferred monobasic acids include acetic acid, propionic acid, and hydroxyacetic acid, more preferred dibasic acids include succinic acid, glutaric acid, maleic acid, fumaric acid, malonic acid, and adipic acid, and most preferred dibasic acid are succinic acid, glutaric acid and maleic acid.

Thiosulfate, thiocyanate, thioether based compounds, thioureas, and a large amount of iodide can be used as the fixing agent, however, thiosulfate is generally used, and in particular ammonium thiosulfate can be most widely used. Sulfite, bisulfite, benzenesulfinic acid or carbonyl bisulfite addition products are preferred as preservatives for a bleach-fixing solution and a fixing solution.

The total processing time of the desilvering process is preferably shorter as long as no desilvering failure is caused. The desilvering processing time is preferably from 5 seconds to 3 minutes and more preferably from 10 seconds to 2 minutes. Further, the processing temperature is from 25° C. to 50° C., and preferably from 35° C. to 45° C. In the preferred temperature range, the desilvering rate is increased and the occurrence of staining after processing is effectively prevented.

Stirring as vigorous as possible in the desilvering process is preferred. Specific examples of the methods of forced stirring include the method wherein a jet of the processing solution is impinged on the surface of the emulsion layer of the photographic material as disclosed in JP-A-62-183460, the method wherein the stirring effect is raised using a rotating means as disclosed in JP-A-62-183461, the method wherein the photographic material is moved such that the surface of the emulsion layer is contact with a wiper blade which is installed in the solution, and the generated turbulent flow at the surface of the emulsion layer increases the stirring effect, and the method wherein the circulating flow rate of the entire processing solution is increased. These means for increasing the stirring level are effective for the bleaching solution, the bleach-fixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carryover of the processing solution from the previous bath to the next bath and is effective for preventing the deterioration of the performances of the processing solution. These effects are especially effective in reducing the processing time of each processing step and reducing the replenishment rate of each processing solution.

The photographic material of the present invention is generally subjected to a washing step and/or a stabilizing step after the desilvering step. The amount of washing water in the washing step can be selected from a wide range according to the characteristics of the photographic materials (e.g., the materials used such as couplers) and the application thereof, the temperature of a washing water, the number of washing tanks (the number of washing stages), the replenishing system, that is, whether a countercurrent system or a concurrent system, and other various conditions. Of the foregoing conditions, the relationship between the number of washing tanks and the amount of water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of the washing water can be greatly reduced, however, problems arise that bacteria proliferate due to the increased residence time of the water in the tanks, and suspended matters produced thereby adhere to the photographic material. In the processing of color photographic materials of the present invention, the method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, the benzotriazole, and the antibacterial agents disclosed in Hiroshi Horiguchi, *Bohkin Bohbai no Kagaku (Antibacterial and Antifungal Chemistry)*, published by Sankyo Shuppan K.K. (1986), *Biseibutsu no Mekkin, Sakkin, Bohbai Gijutsu (Germicidal and Antifungal Techniques of Microorrganisms)*, edited by Eisei Gijutsukai, published by Kogyo Gijutsukai (1982), and *Bohkin Bohbai Zai Jiten (Antibacterial and Antifungal Agents Thesaurus)*, edited by Nippon Bohkin Bohbai Gakkai (1986), can be used.

The pH of the washing water in the processing of the photographic material of the present invention is generally from 4 to 9 and preferably from 5 to 8. The temperature and the time of a washing step can be selected variously according to the characteristics and the end use purpose of the photographic material to be processed, but is generally from 15 to 45 C. for 5 seconds to 10 minutes, and preferably from 25 to 40 C. for 10 seconds to 5 minutes. Further, the photographic material of the present invention can be processed directly with a stabilizing solution without employing a washing step as described above. Any known methods as disclosed in JP-A-57- 8543, JP-A-58-14834 and JP-A-60-220345 can be used in such a stabilizing process.

A stabilizing solution contains dye image stabilizing compounds, for example, formaldehyde, benzaldehydes such as m-hydroxybenzaldehyde, bisulfite addition products of formaldehyde, hexamethylenetetramine and derivatives thereof, hexahydrotriazine and derivatives thereof, dimethylolurea, N-methylol compounds such as N-methylolpyrazole, organic acids and pH buffers. The added amount of these compounds is preferably from 0.001 to 0.02 mol per liter of the stabilizing solution, but the lower the concentration of the free formaldehyde in the stabilizing solution, the less is the splashing of the formaldehyde gas, which is preferred. From these points, m-hydroxybenzaldehyde, hexamethylenetetramine, N-methylolazoles such as N-methylolpyrazole disclosed in JP-A-4-270344, and azolylmethylamines such as N,N'-bis(1,2,4-triazol-1-ylmethyl)piperazine, etc., disclosed in JP-A-4-313753 are preferred as dye image stabilizers. In particular, a combined use of azoles such as 1,2,4-triazole disclosed in JP-A-4-359249 (corresponding to EP 519190 A2) with azolylmethylamine such as 1,4-bis(1,2,4-triazol-1-ylmethyl)piperazine and a derivative thereof is preferred because the combination provides high image stability and low vapor pressure of the formaldehyde. Further, it is preferred to include various compounds in the stabilizing solution, if necessary, for example, ammonium compounds such as ammonium chloride and ammonium sulfite, metal compounds such as Bi and Al, a brightening agent, a hardening agent, alkanolamine disclosed in U.S. Patent 4,786,583, and preservatives which can be included in the aforementioned fixing solution and bleach-fixing solution, e.g., sulfinic acid compounds as disclosed in JP-A-1-231051.

A washing water and a stabilizing solution can contain various surfactants to prevent the generation of water marks during drying of the processed photographic materials. Nonionic surfactants are preferably used, and ethylene oxide addition product of alkylphenol is particularly preferred. Octyl-, nonyl-, dodecyl-, and dinonylphenol are preferred as the alkylphenol and the addition molar number of the ethylene oxide is preferably from 8 to 14. Further, it is preferred to use silicone based surfactants which have the high defoaming ability.

A washing water and a stabilizing solution are preferred to contain various kinds of chelating agents. Preferred chelating agents include aminopolycarboxylic acid, e.g., ethylenediaminetetraacetic acid and diethylenetriaminepentaacetic acid, organic phosphonic acid, e.g., 1-hydroxyethylidene-1,1-diphosphonic acid, N,N,N'-trimethylenephosphonic acid, diethylenetriamine-N,N,N',N'-tetramethylenephosphonic acid, and a hydrolysis product of a maleic anhydride polymer disclosed in EP 345172 Al, and the like.

The overflow generated by the replenishment of the above described washing water and/or stabilizing solution can be reused in other steps such as a desilvering step, etc.

When the above processing solution is concentrated due to evaporation in processing using an automatic processor, etc., it is preferred to replenish an appropriate amount of water, compensating solution, or replenisher of each processing solution to compensate the concentration by evaporation. There is no particular limitation on the method of supplying the water, but preferred examples thereof include a method wherein a separate monitoring water tank is established with the bleaching tank, and the amount of water evaporated from the bleaching tank is calculated from the amount of water evaporated from the monitoring water tank, and water is replenished to the bleaching tank in proportion to this amount of evaporation as disclosed in JP-A-1-254959 and JP-A-1-254960, and a method wherein a liquid level sensor or an overflow sensor is used to compensate the evaporated amount of water as disclosed in JP-A-3-248155, JP-A-3-249644, JP-A-3-249645 and JP-A-3-249646. The water to be added to the processing solution for compensating the evaporated portion of each processing solution may be city water, but preferably a deionized water or sterilized water, which is preferably used in the above washing step.

Various processing solutions of the present invention are used at a temperature of from 10 C. to 50 C., usually from 33 C. to 38 C., however, it is possible to raise the temperature to accelerate the processing to shorten the processing time, on the contrary, to lower the temperature to improve the image quality or stabilization of the processing solution.

Each processing solution of the present invention can be used in processing two or more kinds of photographic materials in common. For example, the cost of the processor can be reduced and the processing can be simplified by processing color negative films and color papers with the same processing solution.

The present invention will be illustrated in more detail with reference to examples below, but these are not to be construed as limiting the invention.

EXAMPLE 1

Preparation of Emulsion

Preparation of Emulsion A-1 (Silver Chloride {100} Tabular Grains) as Comparative Example 1,200 ml of an aqueous solution of gelatin (containing 12 g of deionized alkali-processed ossein gelatin of a methionine content of about 40 μmol/g, pH 4.8) was put in a reaction vessel, while maintaining the temperature at 40 C., 12 ml of Ag-1 solution (containing 14 g of $AgNO_3$, 0.8 g of gelatin, and 0.2 ml of $HNO_3$ 1N solution, in 100 ml of Ag-1 solution) and 12 ml of X-1 solution (containing 6.9 g of NaCl, 0.8 g of gelatin, and 0.3 ml of NaOH 1N solution, in 100 ml of X-1 solution) were simultaneously added to the vessel and mixed at a rate of 24 ml/min. After stirring for 2 minutes, 19 ml of Ag-2 solution (containing 2 g of $AgNO_3$, 0.8 g of gelatin, and 0.2 ml of $HNO_3$ 1N solution, in 100 ml of Ag-2 solution) and 19 ml of X-2 solution (containing 1.4 g of KBr, 0.8 g of gelatin, and 0.2 ml of NaOH 1N solution, in 100 ml of X-2 solution) were simultaneously added thereto and mixed at a rate of 31 ml/min. After stirring for 1 minute, 36 ml of Ag-1 solution and 36 ml of X-1 solution were simultaneously added and mixed at a rate of 48 ml/min. 20 ml of NaCl solution (containing 10 g of NaCl in 100 ml of NaCl solution) was added to the reaction mixture, pH was adjusted to 4.8, and the temperature was raised to 75° C. After ripening was carried out for 20 minutes, the temperature was lowered to 60° C. and pH was adjusted to 5.0. Ag-3 solution (containing 10 g of $AgNO_3$ in 100 ml of Ag-3 solution) and X-3 solution (containing 3.6 g of NaCl in 100 ml of X-3 solution) were added by a controlled double jet method at 130 mV of silver potential. The feed rate at starting time of the addition was 7 ml/min and the feed rate was accelerated at a rate of 0.1 ml per minute and 400 ml of Ag-3 solution was added.

Subsequently, 0.2 mol % per mol of the silver halide of AgBr fine grains having an average sphere-corresponding diameter of 0.03 μm was added, ripening was carried out for about 5 minutes and the halogen conversion was terminated.

Then, a precipitant was added, the temperature was reduced to 30° C., the precipitate was washed with water, an aqueous solution of gelatin was added, and the pH and pCl were adjusted to 6.2 and 3.0, respectively, at 38° C.

The results obtained from the transmission type electron microphotographic image (hereinafter referred to as TEM image) of the replica of the thus-prepared silver halide emulsion grains were as follows.

The silver halide emulsion contained tabular grains having an average circle-corresponding diameter of 0.7 μm and an average silver chloride content of 95.6 mol %, and tabular grains having aspect ratio of 4.0 or more and a ratio of adjacent side lengths of the main plane of 2 or less accounted for 70% of the entire projected area of the grains.

This emulsion was subjected to gold-sulfur-selenium sensitization as described below.

The temperature of the emulsion was elevated to 64° C., Sensitizing Dyes ExS-1, 2 and 3 described below were added in the amounts and ratio so as to provide the desired spectral sensitivity, and then $9.4\times10^{-6}$ mol/mol of Ag of sodium thiosulfate, $3.3\times10^{-6}$ mol/mol of Ag of chloroauric acid, $2.9\times10^{-3}$ mol/mol of Ag of potassium thiocyanate, and $2.5\times10^{-6}$ mol/mol of Ag of N,N-dimethylselenourea were added to thereby effect optimal sensitization.

Emulsion A-2 was prepared in the same manner as the preparation of Emulsion A-1, except that Sensitizing Dyes ExS-1, 2 and 3 were replaced with ExS-4, 5 and 6, and Emulsion A-3 was prepared in the same manner as the preparation of Emulsion A-1 except for using ExS-7 in place of ExS-1, 2 and 3.

Preparation of Emulsion B-1 (Silver Bromide Inner Nucleus, Silver Chloride Outermost Shell Type {100} Tabular Emulsion (Type 1)) as Inventive Example An aqueous solution of gelatin (containing 1,200 ml of $H_2O$, 24 g of deionized alkali-processed ossein gelatin, and 5 ml of $KNO_3$ (1N), and pH was adjusted to 4.0 with a solution of $HNO_3$ (1N)) was put in a reaction vessel with maintaining the temperature at 40° C. 15 ml of $AgNO_3$ solution (containing 3 g of $AgNO_3$ in 100 ml of $AgNO_3$ solution) was added with stirring, after 5 minutes Ag-1 aqueous solution (containing 20 g of $AgNO_3$ in 100 ml of Ag-1 aqueous solution) and the equimolar concentration of X-1 aqueous solution (KBr/KI=98.5/3 in molar ratio) were added thereto by a controlled double jet method at a rate of 48 ml/min for 1 minute. After stirring for 1 minute, pH was adjusted 6.2 with $HNO_3$ solution and KOH solution, and further, silver potential was adjusted to +150 mV with KBr solution (containing 3 g of KBr in 100 ml of KBr solution). Subsequently, the temperature was raised to 75° C. over 10 minutes and ripening was carried out for 30 minutes. The results obtained from the TEM image of the inner shell grains sampled at this time were as follows. The grains had {100} faces as main planes, the shape of the main planes was rectangular parallelogram, the projected area ratio of the grains having aspect ratio of 2 or more was about 92%, the average circle-corresponding diameter was 0.62 μm, the average aspect ratio was 4.77 and the variation coefficient of the grain size distribution was 32%.

Next, 3 ml of $NH_4NO_3$-1 aqueous solution (50 wt %) and 3 ml of $NH_3$-1 aqueous solution (25 wt %) were added to the above emulsion and, further, 0.054 mol of fine grain AgCl emulsion having an average grain size of 0.035 μm was added thereto and ripening was carried out for 18 minutes at 150 mV of silver potential.

Subsequently, 0.2 mol % per mol of the silver halide of AgBr fine grains having an average sphere-corresponding diameter of 0.03 μm was added, and ripening was carried out for about 5 minutes to terminate the halogen conversion.

Then, a precipitant was added, the temperature was reduced to 30° C., the precipitate was washed with water, an aqueous solution of gelatin was added, the emulsion was dispersed again, pH was adjusted to 6.4, and pBr was adjusted to 2.8.

The obtained emulsion grains had, from TEM image, a projected area ratio of the tabular grains (defined in the present invention) of 92%, an average circle-corresponding diameter of 0.7 μm, an average aspect ratio of 7.7, and a variation coefficient of the grain size distribution of 31%. Further, from the comparison with TEM image of the inner shell of the grains, the outer shell of the grains accounted for 30% of the tabular grain volume. It was found, from X-ray diffraction and EPMA, that the $I^-$ content of the inner shell was 3 mol %, the silver bromide content of the inner shell was 57 mol %, and $Cl^-$ content of the outer shell was 90 mol %. Further, from X-ray diffraction of the annealed grains, the total $Br^-$ content was 60 mol %.

This emulsion was subjected to gold-sulfur-selenium sensitization as described below.

The temperature of the emulsion was elevated to 64° C., Sensitizing Dyes ExS-1, 2 and 3 described below were added in the amounts and ratio so as to provide the desired spectral sensitivity, and then $9.4\times10^{-6}$ mol/mol of Ag of sodium thiosulfate, $3.3\times10^{-6}$ mol/mol of Ag of chloroauric acid, $2.9\times10^{-3}$ mol/mol of Ag of potassium thiocyanate, and $2.5\times10^{-6}$ mol/mol of Ag of N,N-dimethylselenourea were added to effect optimal sensitization.

Emulsion B-2 was prepared in the same manner as the preparation of Emulsion B-1, except that Sensitizing Dyes ExS-1, 2 and 3 were replaced with ExS-4, 5 and 6, and Emulsion B-3 was prepared in the same manner as the preparation of Emulsion B-1 except for using ExS-7 in place of ExS-1, 2 and 3.

Preparation of Emulsion C-1 (Silver Chloride Inner Nucleus, Silver Bromide Outer Shell, Silver Chloride Outermost Shell Type {100} Tabular Emulsion (Type 2) as Inventive Example 1,200 ml of an aqueous solution of gelatin (containing 12 g of deionized alkali-processed ossein gelatin of a methionine content of about 40 μmol/g, pH 4.8) was put in a reaction vessel, while maintaining the temperature at 40° C., 12 ml of Ag-1 solution (containing 14 g of $AgNO_3$, 0.8 g of gelatin, and 0.2 ml of $HNO_3$ 1N solution, in 100 ml of Ag-1 solution) and 12 ml of X-1 solution (containing 6.9 g of NaCl, 0.8 g of gelatin, and 0.3 ml of NaOH 1N solution, in 100 ml of X-1 solution) were simultaneously added to the vessel and mixed at a rate of 24 ml/min. After stirring for 2 minutes, 19 ml of Ag-2 solution (containing 2 g of $AgNO_3$, 0.8 g of gelatin, and 0.2 ml of $HNO_3$ 1N solution, in 100 ml of Ag-2 solution) and 19 ml of X-2 solution (containing 1.4 g of KBr, 0.8 g of gelatin, and 0.2 ml of NaOH 1N solution, in 100 ml of X-2 solution) were simultaneously added thereto and mixed at a rate of 31 ml/min. After stirring for 1 minute, 36 ml of Ag-1 solution and 36 ml of X-1 solution were simultaneously added and mixed at a rate of 48 ml/min. 20 ml of NaCl solution (containing 10 g of NaCl in 100 ml of NaCl solution was added to the reaction mixture, pH was adjusted to 4.8, the temperature was raised to 75° C. over 10 minutes and ripening was carried out for 20 minutes. The results obtained from the TEM image of the inner nucleus grains sampled at this time were as follows. The grains had {100} faces as main planes, the shape of the main planes was rectangular parallelogram, the projected area ratio of the grains having aspect ratio of 2 or more was about 70%, the average circle-corresponding diameter was 0.35 μm, and the variation coefficient of the grain size distribution was 32%.

Then, the temperature was lowered to 60° C. and pH was adjusted to 5.0, Ag-3 solution (containing 10 g of $AgNO_3$ in 100 ml of Ag-3 solution) and X-3 solution (containing 7.0 g of KBr in 100 ml of X-3 solution) were added by a controlled double jet method at +130 mV of silver potential. The feed rate at starting time of the addition was 7 ml/min and the feed rate was accelerated at a rate of 0.1 ml per minute and 260 ml of Ag-3 solution was added. The results obtained from the TEM image of the outer shell grains sampled at this time were as follows. The grains had {100} faces as main planes, the shape of the main planes was rectangular parallelogram, the projected area ratio of the grains having aspect ratio of 4 or more was about 70%, the average circle-corresponding diameter was 0.62 μm, the average aspect ratio was 4.77 and the variation coefficient of the grain size distribution was 32%.

Further, after 5 minutes, Ag-3 solution (containing 10 g of $AgNO_3$ in 100 ml of Ag-3 solution) and X-4 solution (containing 3.6 g of NaCl in 100 ml of X-4 solution) were added by a controlled double jet method at +130 mV of silver potential. The feed rate at starting time of the addition was 7 ml/min and the feed rate was accelerated at a rate of 0.1 ml per minute and 140 ml of Ag-3 solution was added.

Subsequently, 0.2 mol % per mol of the silver halide of AgBr fine grains having an average sphere-corresponding diameter of 0.03 μm was added, and ripening was carried out for about 5 minutes to terminate the halogen conversion.

Then, a precipitant was added, the temperature was reduced to 30° C., the precipitate was washed with water, an aqueous solution of gelatin was added, and the pH and pCl were adjusted to 6.2 and 3.0, respectively, at 38° C.

The obtained emulsion grains had, from TEM image, a projected area ratio of the tabular grains (defined in the present invention) of about 70%, an average circle-corresponding diameter of 0.7 μm, an average aspect ratio of 7.7, and a variation coefficient of the grain size distribution of 32%. Further, from the comparison of TEM images of the inner nucleus and the outer shells, the inner nucleus (a high silver chloride part), the outer shell (a high silver bromide layer) and the outermost shell (a high silver chloride layer) of the grains accounted for 15%, 55% and 30%, respectively, of the tabular grain volume, and from X-ray diffraction and EPMA, the silver bromide composition of the outer shell was 95 mol % and the silver chloride content of the outermost shell was 90 mol %. Further, from X-ray diffraction of the annealed grains, the total $Br^-$ content was 55 mol %.

This emulsion was subjected to gold-sulfur-selenium sensitization as described below.

The temperature of the emulsion was elevated to 64° C., Sensitizing Dyes ExS-1, 2 and 3 described below were added in the amounts and ratio so as to provide the desired spectral sensitivity, and then $9.4\times10^{-6}$ mol/mol of Ag of sodium thiosulfate, $3.3\times10^{-}$mol/mol of Ag of chloroauric acid, $2.9\times10^{-3}$ mol/mol of Ag of potassium thiocyanate, and $2.5\times10^{-6}$ mol/mol of Ag of N,N-dimethylselenourea were added to effect optimal sensitization.

Emulsion C-2 was prepared in the same manner as the preparation of Emulsion C-1, except that Sensitizing Dyes ExS-1, 2 and 3 were replaced with ExS-4, 5 and 6, and Emulsion C-3 was prepared similarly except for using ExS-7 in place of ExS-1, 2 and 3.

1) Support

The support which was used in the present invention was prepared as follows.

100 parts by weight of polyethylene-2,6-naphthalate polymer and 2 parts by weight of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C. and further thermally fixed for 6 seconds at 250° C. to obtain a PEN film having a thickness of 90 μm. Appropriate amounts of blue dyes, magenta dyes and yellow dyes were added to this PEN film (I-1, I-4, I-6, 1-24, 1-26, 1-27 and II-5 disclosed in JIII Journal of Technical Disclosure No. 94-6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on each side of the support an undercoat solution having the following composition was coated (10 cc/$m^2$, using a bar coater): 0.1 g/$m^2$ of gelatin, 0.01 g/$m^2$ of sodium α-sulfo-di-2-ethylhexylsuccinate, 0.04 g/$m^2$ of salicylic acid, 0.2 g/$m^2$ of p-chlorophenol, 0.012 g/$m^2$ of $(CH_2{=}CHSO_2CH_2CH_2NHCO)_2CH_2$, and 0.02 g/$m^2$ of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C).

3) Coating of Backing Layer

On one side of the above support after undercoat layer coating, an antistatic layer, a magnetic recording layer and a sliding layer having the following compositions were coated as backing layers.

3-1) Coating of antistatic layer 0.2 g/$m^2$ of a dispersion of fine grain powder of a stannic oxide-antimony oxide composite having the average grain size of 0.005 μm and specific resistance of 5 Ω.cm (the grain size of the second agglomerate: about 0.08 μm), 0.05 g/m$^2$ of gelatin, 0.02 g/m$^2$ of $(CH_2{=}CHSO_2CH_2CH_2NHCO)_2CH_2$, and 0.005 g/m$^2$ of polyoxyethylene-p-nonylphenol (polymerization degree: 10) and resorcin were coated.

3-2) Coating of magnetic recording layer 0.06 g/m$^2$ of cobalt-y-iron oxide which was coated with 3-polyoxyethylene-propyloxytrimethoxysilane having a polymerization degree of 15 in an amount of 15 wt % (specific surface area: 43 m$^2$/g, major axis: 0.14 μm, minor axis: 0.03 μm, saturation magnetization: 89 emu/g, $Fe^{+2}/Fe^{+3}$ =6/94, the surface was treated with 2 wt % of aluminum oxide and silicon oxide based on the iron oxide), 1.2 g/m$^2$ of diacetyl cellulose (dispersion of the iron oxide was carried out using an open kneader and a sand mill), and 0.3 g/m$^2$ of $C_2H_5C[CH_2OCONHC_6H_3(CH_3)NCO]_3$ as a curing agent were coated with a bar coater using acetone, methyl ethyl ketone and cyclohexanone as solvents, to thereby obtain a magnetic recording layer having a film thickness of 1.2 μm. As matting agents, silica grains (0.3 μm) and an aluminum oxide abrasive (0.15 μm) coating-treated with 3-polyoxyethylene-propyloxytrimethoxysilane (polymerization degree: 15) (15 wt %) were added each in an amount of 10 mg/m$^2$. Drying was conducted at 115° C. for 6 minutes (the temperature of the roller and transporting device of the drying zone was 115° C.). The increase of the color density of $D^B$ (density obtained by measurement with a blue light) of the magnetic recording layer by X-Rite (a blue filter) was about 0.1, and saturation magnetization moment of the magnetic recording layer was 4.2 emu/g, coercive force was $7.3\times10^4$ A/m, and rectangular ratio was 65%.

3-3) Preparation of sliding layer

Diacetyl cellulose (25 mg/m$^2$), and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 9 mg/m$^2$) were coated. This mixture of Compound a/Compound b was dissolved in xylene/propylene monomethyl ether (1/1) by heating at 105° C., and poured into propylene monomethyl ether (10 time amount) at room temperature and dispersed, and further dispersed in acetone (average particle size: 0.01 μm). As matting agents, silica grains (0.3 μm) and aluminum oxide (0.15 μm) coated with 3-polyoxyethylene-propyloxytrimethoxysilane having a polymerization degree of 15 in an amount of 15 wt % were added each in an amount of 15 mg/m$^2$. Drying was conducted at 115° C. for 6 minutes (the temperature of the roller and transporting device of the drying zone was 115° C.). The thus-obtained sliding layer showed excellent performances of dynamic friction coefficient of 0.06 (a stainless steel hard ball of 5 mmϕ, load: 100 g, rate: 6 cm/min), static friction coefficient of 0.07 (a clip method), and the sliding property with the surface of the emulsion side provided dynamic friction coefficient of 0.12.

Layer Structure

Using the thus-prepared Emulsion A (comparative example), and Emulsions B and C (invention), each layer having the composition shown below was multilayer coated on the above support. Sample Nos. 101, 102 and 103 were prepared with the constitution of each of Emulsions X, Y and Z in the third layer, the fifth layer and the seventh layer as shown below.

| Sample No. | Emulsion X (3rd layer) | Emulsion Y (5th layer) | Emulsion Z (7th layer) | Remarks |
|---|---|---|---|---|
| 101 | A-1 | A-2 | A-3 | Comparison |
| 102 | B-1 | B-2 | B-3 | Invention |
| 103 | C-1 | C-2 | C-3 | Invention |

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorbing Agent

HBS: High Boiling Point Organic Solvent

H: Gelatin Hardening Agent

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

| | |
|---|---|
| First Layer: Antihalation Layer | |
| Black Colloidal Silver | 0.09 as silver |
| Gelatin | 1.30 |
| ExF-1 | $2.0\times10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Second Layer: Interlayer | |
| Polyethyl Acrylate Latex | 0.20 |
| Gelatin | 1.04 |
| Third Layer: Red-Sensitive Emulsion Layer | |
| Emulsion X | 1.3 as silver |
| ExS-1 | $6.0\times10^{-4}$ |
| ExS-2 | $3.2\times10^{-5}$ |
| ExS-3 | $9.0\times10^{-4}$ |
| ExC-1 | 0.43 |
| ExC-2 | 0.20 |
| Cpd-2 | 0.023 |
| HBS-1 | 0.20 |
| Gelatin | 1.50 |
| Fourth Layer: Interlayer | |
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |
| Fifth Layer: Green-Sensitive Emulsion Layer | |
| Emulsion Y | 1.1 as silver |
| ExS-4 | $3.8\times10^{-5}$ |
| ExS-5 | $2.9\times10^{-4}$ |
| ExS-6 | $9.8\times10^{-4}$ |
| ExM-1 | 0.28 |
| HBS-1 | 0.18 |
| HBS-3 | $4.0\times10^{-3}$ |
| Gelatin | 1.0 |
| Sixth Layer: Yellow Filter Layer | |
| Yellow Colloidal Silver | 0.005 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |

-continued

| | |
|---|---|
| HBS-1 | 0.60 |
| Gelatin | 0.70 |
| Seventh Layer: Blue-Sensitive Emulsion Layer | |
| Emulsion Z | 1.00 as silver |
| ExS-7 | $4.0 \times 10^{-4}$ |
| ExY-1 | 0.35 |
| Cpd-2 | 0.10 |
| Cpd-3 | $1.0 \times 10^{-3}$ |
| HBS-1 | 0.070 |
| Gelatin | 0.70 |
| Eighth Layer: First Protective Layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.2 |
| Ninth Layer: Second Protective Layer | |
| Silver Chloride Emulsion M | 0.10 as silver |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The vibrating ball mill which was used was BO type ball mill manufactured by Chuo Koki. The content was taken out after dispersion and added to 8 g of a 12.5% aqueous solution of gelatin and the beads were removed by filtration and the gelatin dispersion of the dye was obtained. The average grain size of fine grains of the dye was 0.44 μm.

Solid dispersions of ExF-3, ExF-4 and ExF-6 were obtained in the same manner. The average grain sizes of fine grains of the dyes were 0.24 μm, 0.45 μm and 0.52 μm, respectively. ExF-5 was dispersed according to the micro-precipitation dispersion method disclosed in Example 1 of EP 549489 A. The average grain size of fine grains of ExF-5 was 0.06 μm.

ExC-1

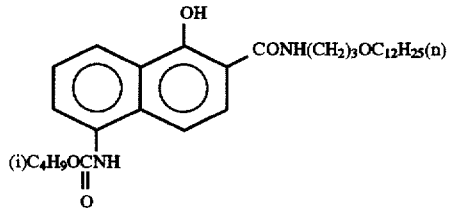

ExC-2

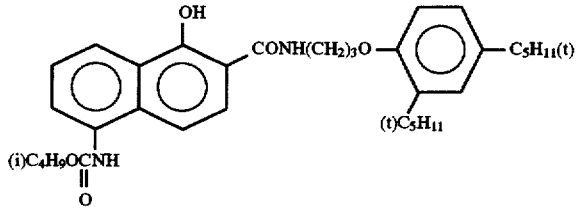

ExM-1

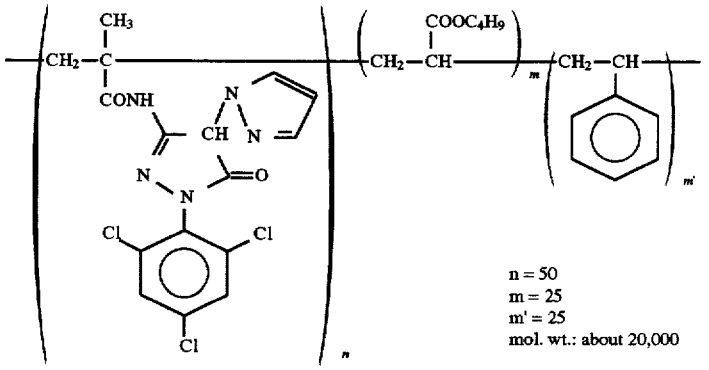

-continued
ExY-1
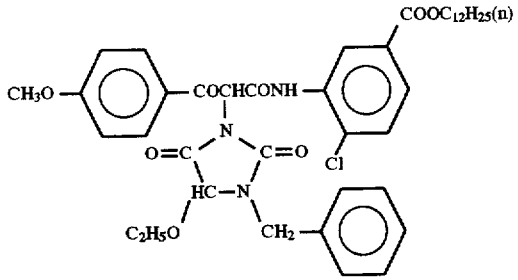
ExF-1
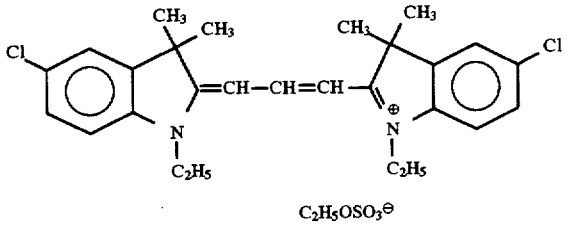
ExF-2
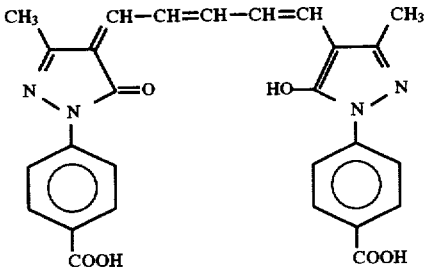
ExF-3
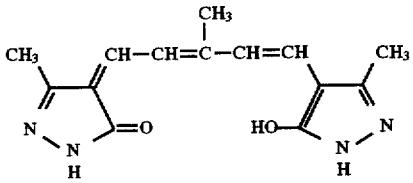
ExF-4
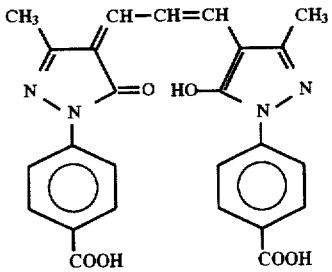
ExF-5
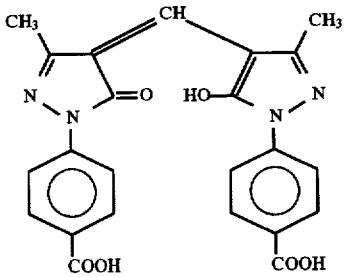
ExF-6
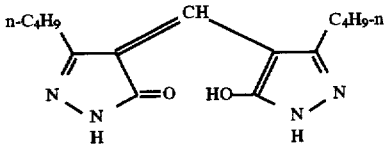
ExF-7
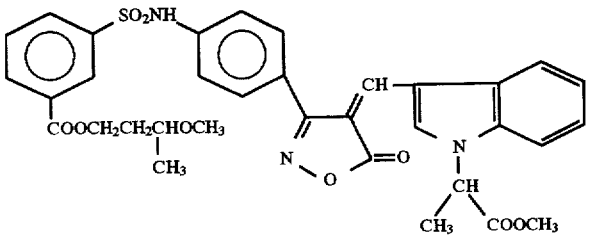

-continued
Cpd-1
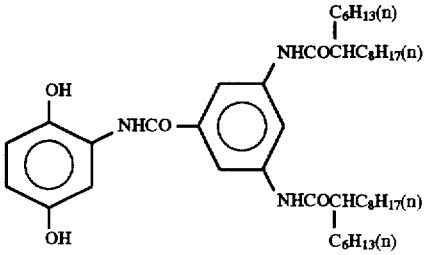
Cpd-2
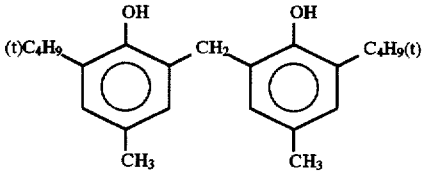
Cpd-3
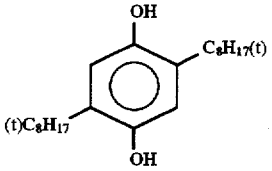
UV-1
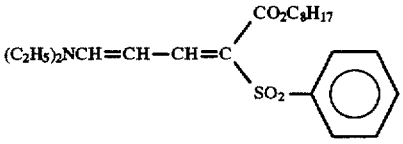
UV-2
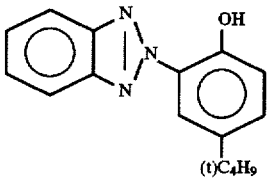
UV-3
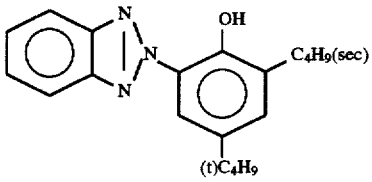
Tricresyl Phosphate HBS-1
Di-n-butyl Phthalate HBS-2
HBS-3
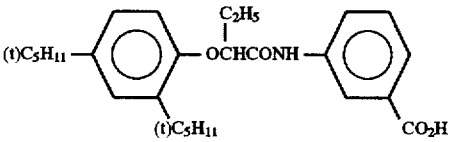
Tri(2-ethylhexy) Phosphate HBS-4
ExS-1
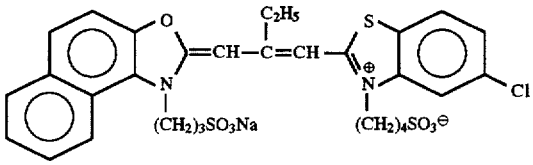
ExS-2
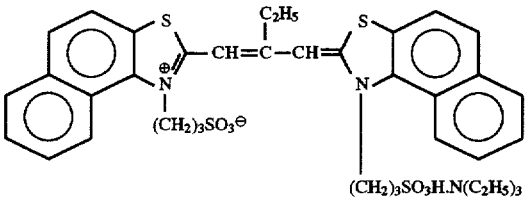
ExS-3
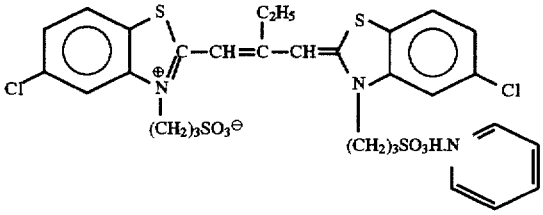
ExS-4
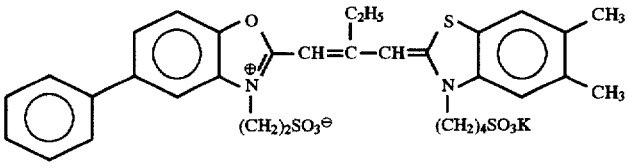

-continued
ExS-5
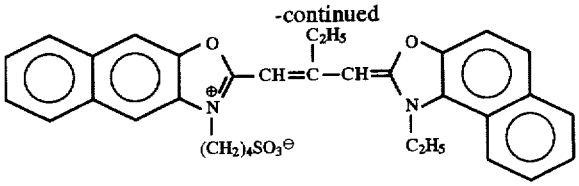
ExS-6
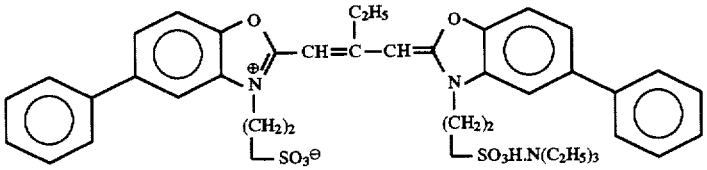
ExS-7
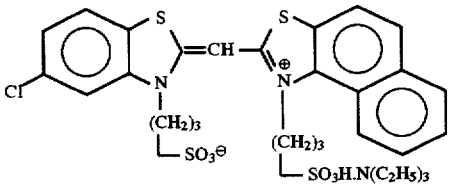
S-1
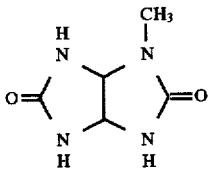
H-1
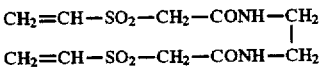
B-1
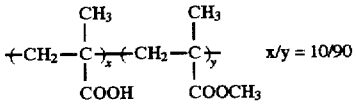
x/y = 10/90
B-2
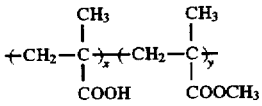
x/y = 40/60
B-3
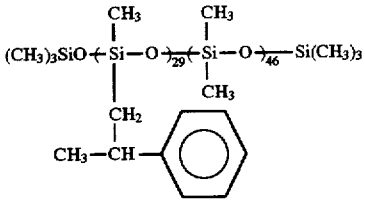
B-4
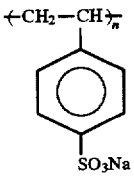
B-5
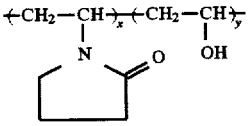
x/y = 70/30
B-6
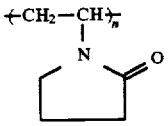
(mol. wt. 約10,000)
W-1
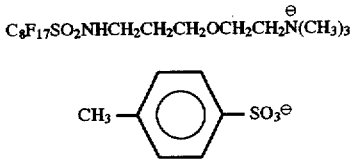
W-2
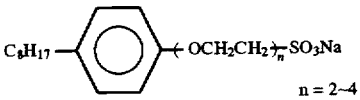
n = 2–4
W-3
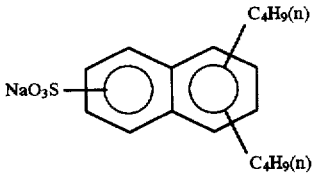
F-1
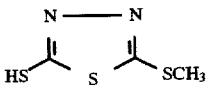
F-2
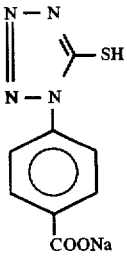

-continued

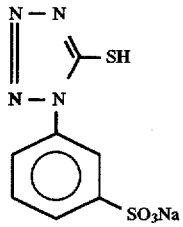

F-3

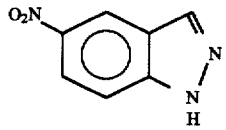

F-4

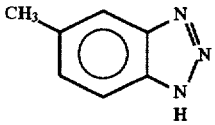

F-5

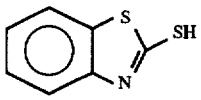

F-6

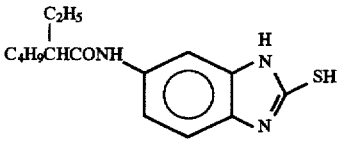

F-7

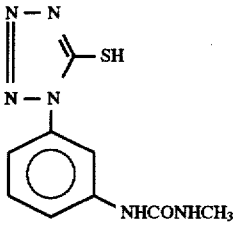

F-8

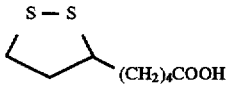

F-9

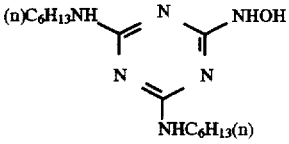

F-10

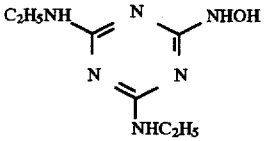

F-11

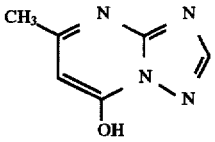

F-12

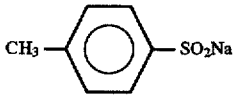

F-13

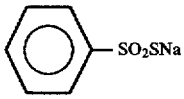

F-14

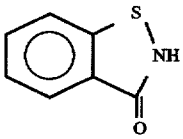

F-15

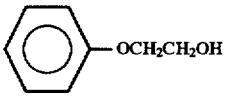

F-16

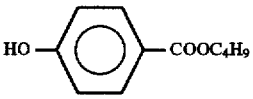

F-17

Process for Silver Chloride

Samples Nos. 101 to 103 were development processed according to the following process.

Processing Step

| Process | Processing Time (sec) | Processing Temperature (°C.) |
|---|---|---|
| Color Development | 45 | 38 |
| Bleaching | 30 | 38 |
| Fixing | 45 | 38 |
| Stabilization (1) | 20 | 38 |
| Stabilization (2) | 20 | 38 |

-continued

| Process | Processing Time (sec) | Processing Temperature (°C.) |
|---|---|---|
| Stabilization (3) | 20 | 38 |
| Drying | 30 | 60 |

* Stabilization was conducted in a countercurrent system from (3) to (1).

The compositions of the processing solutions are shown below.

| Color Developing Solution | |
|---|---|
| Ethylenediaminetetraacetic Acid | 3.0 g |
| Disodium 4,5-Dihydroxybenzene-1,3-disulfonate | 0.3 g |
| Potassium Carbonate | 30.0 g |
| Sodium Chloride | 5.0 g |
| Disodium-N,N-bis(sulfonatoethyl)-hydroxylamine | 6.0 g |
| 4-[N-Ethyl-N-(β-hydroxyethyl)amino]-2-methylaniline Sulfate | 5.0 g |
| Water to make | 1.0 liter |
| pH (adjusted with potassium hydroxide and sulfuric acid) | 10.00 |
| **Bleaching Solution** | |
| Ammonium 1,3-Diaminopropanetetraacetato Ferrate Monohydrate | 140 g |
| 1,3-Diaminopropanetetraacetic Acid | 3 g |
| Ammonium Bromide | 80 g |
| Ammonium Nitrate | 15 g |
| Hydroxyacetic Acid | 25 g |
| Acetic Acid (98%) | 40 g |
| Water to make | 1.0 liter |
| pH (adjusted with aqueous ammonia and acetic acid) | 4.3 |
| **Fixing Solution** | |
| Disodium Ethylenediaminetetraacetate | 15 g |
| Ammonium Sulfite | 19 g |
| Imidazole | 15 g |
| Ammonium Thiosulfate (70 wt %) | 280 ml |
| Water to make | 1.0 liter |
| pH (adjusted with aqueous ammonia and acetic acid) | 7.4 |
| **Stabilizing Solution** | |
| Sodium p-Toluenesulfinate | 0.03 g |
| Polyoxyethylene-p-monononylphenyl Ether (average polymerization degree: 10) | 0.2 g |
| Disodium Ethylenediaminetetraacetate | 0.05 g |
| 1,2,4-Triazole | 1.3 g |
| 1,4-Bis(1,2,4-triazol-1-ylmethyl)-piperazine | 0.75 g |
| Water to make | 1.0 liter |
| pH (adjusted with aqueous ammonia and acetic acid) | 8.5 |

Sample Nos. 101 to 103 were subjected to wedge exposure for sensitometry (3,200° K., 1/10", 0.1 CMS) and further processed according to the process for silver chloride. The cyan density of each color image obtained was measured.

In addition, the color images were observed using a magnifier of 10-fold through a red filter and the graininess was evaluated by means of organoleptic test. The graininess of the color image of Sample No. 102 processed according to the process for silver chloride was taken as 100, and that of Sample No. 101 processed according to the process for silver chloride as 25, and the graininess of the color images of the other samples were indicated as relative evaluation thereto. The larger the numeral, the better is the evaluation. Further, the remaining silver amount of the sample after processing was measured.

| Sample No. | Process | Cyan (Dmax) | Relative Sensitivity | Graininess | Remaining Amount of Silver after Processing ($g/m^2$) | Remarks |
|---|---|---|---|---|---|---|
| 101 | Process for silver chloride | 1.9 | 100 | 25 | 0.13 | Comparison |
| 102 | Process for silver chloride | 2.0 | 100 | 100 | 0.06 | Invention |
| 103 | Process for silver chloride | 2.0 | 100 | 100 | 0.06 | Invention |

Sample No. 101 in which silver chloride tabular grains (comparative example) were used provided high cyan Dmax and high sensitivity when processed by the process for silver chloride, while graininess was inferior and the remaining silver amount was large. On the other hand, Sample Nos. 102 and 103 in which silver chlorobromide emulsion of a multiple structure (invention) was used were excellent in graininess and the remaining amount of silver was less.

Process for Developing Agent Inclusion Type

Sample Nos. (1) and (2) which contained a developing agent within the material were prepared by incorporating Compound (6) of the present invention in the third, fifth and seventh layers in the above layer structure in the molar ratio shown below.

Preparation of Developing Agent Inclusion Type Sample (1)

Sample No. 201 (comparative example) and Sample Nos. 202 and 203 (inventive examples) were prepared in the same manner as in the preparation of Sample Nos. 101 to 103 except that Compound (6) of the present invention was added to each of the third, fifth, and seventh layers in such an amount that the molar ratio of Compound (6) to the silver halide contained in each layer of the third, fifth and seventh layers are 10%, 3.3%, and 5%, respectively.

Preparation of Developing Agent Inclusion Type Sample (2)

Sample No. 301 (comparative example) and Sample Nos. 302 and 303 (invention) were prepared in the same manner as in the preparation of developing agent inclusion type sample (1) except that Compound (6) was added to the third, fifth and seventh layers at a molar ratio of 50% based on the silver halide in each layer.

The total film thickness of all the hydrophilic colloid layers on the side of the support having the emulsion layers was 13.5 μm with respect to Sample Nos. 101 to 103 and 14.5 μm with respect to Sample Nos. 201 to 203 and Sample Nos. 301 to 303.

Sample Nos. 201 to 203 and Sample Nos. 301 to 303 were development processed according to the following process.

Processing Step

| Process | Processing Time (sec) | Processing Temperature (°C.) |
|---|---|---|
| Color Development (Activator Process) | 20 | 38 |
| Bleaching | 10 | 38 |
| Fixing | 15 | 38 |

-continued

| Process | Processing Time (sec) | Processing Temperature (°C.) |
|---|---|---|
| Stabilization (1) | 10 | 38 |
| Stabilization (2) | 10 | 38 |
| Stabilization (3) | 10 | 38 |
| Drying | 30 | 60 |

*Stabilization was conducted in a countercurrent system from (3) to (1).

The composition of the processing solution is shown below.

| | |
|---|---|
| Color Developing Solution (Color Developing Solution (Activator Solution) | |
| Diethylenetriaminepentaacetic Acid | 3.0 g |
| Potassium Carbonate | 30.0 g |
| Sodium Chloride | 5.0 g |
| Water to make | 1.0 liter |
| pH (adjusted with potassium hydroxide and sulfuric acid) | 10.00 |
| Bleaching Solution | |
| Ammonium 1,3-Diaminopropanetetraacetato Ferrate Monohydrate | 140 g |
| 1,3-Diaminopropanetetraacetic Acid | 3 g |
| Ammonium Bromide | 85 g |
| Ammonium Nitrate | 18 g |
| Aqueous Ammonia (27%) | 10 g |
| Acetic Acid (98%) | 50 g |
| Potassium Carbonate | 10 g |
| Water to make | 1.0 liter |
| pH (adjusted with aqueous ammonia and acetic acid) | 4.3 |
| Fixing Solution | |
| Disodium Ethylenediaminetetraacetate | 2 g |
| Sodium Sulfite | 14 g |
| Sodium Bisulfite | 10 g |
| Ammonium Thiosulfate (70 wt %) | 210 ml |
| Ammonium Thiocyanate | 160 g |
| Thiourea | 2 g |
| Water to make | 1.0 liter |
| pH (adjusted with aqueous ammonia and acetic acid) | 6.5 |
| Stabilizing Solution | |
| Surfactant [$C_{10}H_{21}$-O-($CH_2CH_2O$)-H] | 0.2 g |
| Polymaleic Acid (average molecular weight: 2,000) | 0.1 g |
| 1,2-Benzisothiazolin-3-one | 0.05 g |
| Hexamethylenetetramine | 5.5 g |
| Water to make | 1.0 liter |
| pH (adjusted with aqueous ammonia and acetic acid) | 8.5 |

Sample Nos. 201 to 203 and Sample Nos. 301 to 303 were subjected to wedge exposure for sensitometry (3,200° K., 1/10", 0.1 CMS) and further processed according to developing agent inclusion type process. The cyan density of each color image obtained was measured.

In addition, the color images were observed using a magnifier of 10-fold through a red filter and the graininess was evaluated by means of organoleptic test. Evaluation was conducted according to the same reference value of the relative evaluation of the graininess of samples processed according to the process for silver chloride for comparing with samples processed by the process for silver chloride. The larger the numeral, the better is the evaluation. Further, the remaining silver amount of the sample after processing was measured.

| Sample No. | Process | Cyan (Dmax) | Relative Sensitivity | Graininess | Remaining Amount of Silver After Processing ($g/m^2$) | Remarks |
|---|---|---|---|---|---|---|
| 201 | Developing agent | 2.1 | 120 | 125 | 0.06 | Comparison |
| 202 | Process for developing agent including type | 1.9 | 120 | 190 | 0.02 | Invention |
| 203 | Process for developing agent including type | 1.9 | 120 | 190 | 0.02 | Invention |
| 301 | Process for developing agent including type | 2.1 | 120 | 110 | 0.07 | Comparison |
| 302 | Process for developing agent including type | 1.9 | 120 | 150 | 0.02 | Invention |
| 303 | Process for developing agent including type | 1.9 | 120 | 150 | 0.02 | Invention |

The relative sensitivity of each sample processed according to the process for developing agent inclusion type was superior to the relative sensitivity of samples processed according to the process for silver chloride.

Similar results were obtained with respect to the graininess, in particular, the graininess of each sample in which the tabular grains having a multiple structure of the present invention were used (Sample Nos. 202 and 203 and Samples 302 and 303) provided conspicuously excellent graininess in comparison with comparative samples using pure silver chloride tabular grains (Sample Nos. 201 and 301). Further, from the difference in graininess of Sample Nos. 202 and 203 and Sample Nos. 302 and 303, it can be understood that developing agent inclusion type sample (1) gives superior graininess to the graininess of developing agent inclusion type sample (2).

In addition, with respect to the remaining amount of silver after processing, each sample in which the tabular grains having a multiple structure of the present invention were used shows extremely excellent values compared with each comparative sample using pure silver chloride tabular grains.

EXAMPLE 2

Preparation of Emulsion D-1 (silver bromide inner nucleus, silver chloride outermost shell type {100} tabular emulsion (type 1/) (invention)

An aqueous solution of gelatin (containing 1,200 ml of $H_2O$, 24 g of deionized alkali-processed ossein gelatin and 5 ml of $KNO_3$ (1N), and being adjusted with a solution of $HNO_3$ (1N) to have a pH of 4.0) was put in a reaction vessel with maintaining the temperature at 40° C. 15 ml of $AgNO_3$ solution (containing 3 g of $AgNO_3$ in 100 ml of $AgNO_3$ solution) was added with stirring, after 5 minutes Ag-1 aqueous solution (containing 20 g of $AgNO_3$ in 100 ml of Ag-1 aqueous solution) and the equimolar concentration of X-1 aqueous solution (KBr/KI =98.5/3 in molar ratio) were added thereto by a controlled double jet method at a rate of 48 ml/min for 1 minute. After stirring for 1 minute, pH was adjusted 6.2 with $HNO_3$ solution and KOH solution, and further, silver potential was adjusted to +150 mV with KBr solution (containing 3 g of KBr in 100 ml of KBr solution). Subsequently, the temperature was raised to 75° C. over 10 minutes and ripening was carried out for 30 minutes. The results obtained from the TEM image of the inner shell grains sampled at this time were as follows. The grains had {100} faces as main planes, the shape of the main planes was rectangular parallelogram, the projected area ratio of the grains having aspect ratio of 2 or more was about 92%, the average circle-corresponding diameter was 0.62 μm, the average aspect ratio was 4.77 and the variation coefficient of the grain size distribution was 32%.

Then, Ag-1 solution (containing 10 g of $AgNO_3$ in 100 ml of Ag-1 solution) and X-2 solution (containing 14 g of NaCl in 100 ml of X-2 solution) were added by a controlled double jet method at +150 mV of silver potential. The feed rate at starting time of the addition was 7 ml/min and the feed rate was accelerated at a rate of 0.1 ml per minute, and 190 ml of Ag-1 solution was added.

Further, 3 ml of $NH_4NO_3$-1 aqueous solution (50 wt %) and 3 ml of $NH_3$-1 aqueous solution (25 wt %) were added to the above emulsion and, further, 0.054 mol of fine grain AgCl emulsion having an average grain size of 0.035 μm was added thereto and ripening was carried out for 18 minutes at +150 mV of silver potential.

Subsequently, 0.2 mol % per mol of the silver halide of AgBr fine grains having an average sphere-corresponding diameter of 0.03 μm was added, ripening was carried out for about 5 minutes to terminate the halogen conversion.

Then, a precipitant was added, the temperature was reduced to 30° C., the precipitate was washed with water, an aqueous solution of gelatin was added, the emulsion was dispersed again, pH was adjusted to 6.4, and pBr was adjusted to 2.8.

The obtained emulsion grains had, from TEM image, a projected area ratio of the tabular grains of 92%, an average circle-corresponding diameter of 1.1 μm, an average aspect ratio of 8.2, and a variation coefficient of the grain size distribution of 31%. Further, from the comparison with TEM image of the inner shell of the grains, the outer shell of the grains accounted for 30% of the tabular grain volume. It was found, from X-ray diffraction and EPMA, that the $I^-$ content of the inner shell was 2 mol % and $Cl^-$ content of the outer shell was 90 mol %. Further, from X-ray diffraction of the annealed grains, the $Br^-$ content in the grain was 60 mol %.

This emulsion was subjected to gold-sulfur-selenium sensitization as described below.

The temperature of the emulsion was elevated to 64° C., Sensitizing Dyes ExS-1, 2 and 3 described below were added in the amounts and ratio so as to provide the desired spectral sensitivity, and then $9.4\times10^{-6}$ mol/mol of Ag of sodium thiosulfate, $3.3\times10^{-6}$ mol/mol of Ag of chloroauric acid, $2.9\times10^{-3}$ mol/mol of Ag of potassium thiocyanate, and $2.5\times10^{-6}$ mol/mol of Ag of N,N-dimethylselenourea were added to effect optimal sensitization.

Emulsion D-2 was prepared in the same manner as the preparation of Emulsion D-1 except that Sensitizing Dyes ExS-1, 2 and 3 were replaced with ExS-4, 5 and 6, and Emulsion D-3 was prepared in the same manner as the preparation of Emulsion D-1 except for using ExS-7.

Layer Structure

Sample No. 5 having the following composition was prepared by providing high sensitivity emulsion layer A and low sensitivity emulsion layer B in each of the third, fifth and seventh layers of the above layer structure and Emulsion D (invention) was used as high sensitivity layer emulsion and Emulsion B invention) as low sensitivity layer emulsion.

| | |
|---|---|
| Layer 3-A: High Sensitivity Red-Sensitive Emulsion Layer | |
| Emulsion D-1 | 0.65 as silver |
| ExS-1 | $3.0\times10^{-4}$ |
| ExS-2 | $1.6\times10^{-5}$ |
| ExS-3 | $4.5\times10^{-4}$ |
| ExC-1 | 0.22 |
| ExC-2 | 0.10 |
| Cpd-2 | 0.012 |
| HBS-1 | 0.10 |
| Gelatin | 0.75 |
| Compound (7) | 10% (molar ratio) based on silver |
| Layer 3-B: Low Sensitivity Red-Sensitive Emulsion Layer | |
| Emulsion B-1 | 0.65 as silver |
| Other additives are the same as in Layer 3-A | |
| Layer 5-A: High Sensitivity Green-Sensitive Emulsion Layer | |
| Emulsion D-2 | 0.60 as silver |
| ExS-4 | $7.9\times10^{-5}$ |
| ExS-5 | $1.4\times10^{-4}$ |
| ExS-6 | $0.4\times10^{-4}$ |
| ExM-1 | 0.14 |
| HBS-1 | 0.09 |
| HBS-3 | $2.0\times10^{-3}$ |
| Gelatin | 0.5 |
| Compound (7) | 3.3% (molar ratio) based on silver |
| Layer 5-B: Low Sensitivity Green-Sensitive Emulsion Layer | |
| Emulsion B-2 | 0.60 as silver |
| Other additives are the same as in Layer 5-A | |
| Layer 7-A: High Sensitivity Blue-Sensitive Emulsion Layer | |
| Emulsion D-3 | 0.50 as silver |
| ExS-7 | $2.0\times10^{-4}$ |
| ExY-1 | 0.17 |
| Cpd-2 | 0.05 |
| Cpd-3 | $5\times10^{-4}$ |
| HBS-1 | 0.035 |
| Gelatin | 0.35 |
| Compound (8) | 5% (molar ratio) based on silver |
| Layer 7-B: Low Sensitivity Blue-Sensitive Emulsion Layer | |
| Emulsion B-3 | 0.50 as silver |

Sample No. 6 was prepared in the same manner as in the preparation of Sample No. 5 except that Compound (7) was added to layer 3-A, layer 3-B, layer 5-A, and layer 5-B at a molar ratio of 5%, 15%, 1.2%, and 5.4%, respectively, based on the amount of silver halide contained in each layer and Compound (8) was added in layer 7-A and layer 7-B at a molar ratio of 0.8% and 9.2%, respectively, based on the amount of silver halide contained in each layer.

After exposure in the same manner as in Example 1, samples were processed according to the process for developing agent inclusion type and color images were obtained.

The same evaluation was conducted as in Example 1 and the results obtained are shown below.

| Sample No. | Relative Value of Graininess of Magenta Image |
|---|---|
| 5 | 75 |
| 6 | 120 |

Sample No. 6, in which developing agent was incorporated such that the content ratio per silver halide of the developing agent of the layer having low sensitivity was larger than that of the layer having high sensitivity, exhibited superior graininess to Sample No. 5 in which both the layers having low sensitivity and the layers having high sensitivity had the same content ratio of the developing agent.

Sample No. 6, in which developing agent was incorporated such that the layers having low sensitivity had the content ratio per silver halide of the developing agent larger than the corresponding layers having high sensitivity, exhibited superior graininess to Sample No. 5 in which both the layers having low sensitivity has the same and the layers having high sensitivity had the same content ratio of the developing agent as the corresponding layers having low sensitivity.

Sample No. 102 or 103 which contained the tabular grains of the multiple structure of the present invention and processed according to the process for silver chloride exhibited high sensitivity, excellent graininess and largely reduced amount of remaining silver after processing compared with Sample No. 101 (comparative example) which contained silver chloride tabular grains and subjected to the same process. This excellent effect is due to the emulsion grain of the present invention comprising the multiple structure of the outermost shell containing silver chloride which has an excellent developing ability and the inner nucleus or inner layer containing silver bromide which controls development progress.

Further, Sample Nos. 202 and 203 and Sample Nos. 302 and 303 which contained the tabular grains of the multiple structure of the present invention and processed according to the process for developing agent inclusion type exhibited high sensitivity, still more excellent graininess and largely reduced amount of remaining silver after processing compared with Sample Nos. 201 and 301 which contained silver chloride tabular grains and subjected to the same process. In particular, Sample Nos. 202 and 203 (developing agent inclusion type sample (1)) which were subjected to the process for developing agent inclusion type exhibited conspicuously excellent graininess and the remaining amount of silver after processing was reduced to the value of absolutely no problem in practical use. From the above it can be seen that the tabular grains having the multiple structure of the present invention produce very excellent effect when used in combination with the developing agent inclusion type process.

With respect to graininess, when the tabular grains having the multiple structure of the present invention are contained in a high sensitivity layer and a low sensitivity layer and processed according to the process for developing agent inclusion type, it is more effective that the developing agent is included with the content, per silver halide, in the low sensitivity layer being larger than that in the high sensitivity layer than the case of inclusion in the same ratio.

While the invention has been described in detail and with reference to specific examples thereof, it will be apparent to one skilled in the art that various changes and modifications can be made therein without departing from the spirit and scope thereof.

What is claimed is:

1. A silver halide emulsion containing tabular silver halide grains in such an amount that the projected area of the tabular silver halide grains accounts for 30% or more of the entire projected area of silver halide grains contained in the emulsion, said tabular silver halide grains having:

(1) a multiple structure comprising one inner shell and one or more outer shells positioned outside of the inner shell, wherein the outermost shell of the outer shells contains 50 mol % or more of silver chloride and at least one of the outer shells and the inner shell which are positioned inside of the outermost shell contains 50 mol % or more of silver bromide;

(2) {100} faces as two main planes parallel to each other; and (3) an aspect ratio of 2 or more.

2. The silver halide emulsion of claim 1, wherein the silver amount of the outermost shell accounts for 15 mol % or more of that of the entire silver halide grain.

3. The silver halide emulsion of claim 2, wherein the silver amount of the outermost shell accounts for 20 to 50 mol % of that of the entire silver halide grain.

4. The silver halide emulsion of claim 2, wherein the silver amount of the outermost shell accounts for 20 to 40 mol % of that of the entire silver halide grain.

5. The silver halide emulsion of claim 1, wherein the outermost shell of the outer shells contains 70 mol % or more of silver chloride.

6. The silver halide emulsion of claim 1, wherein the outermost shell of the outer shells contains 90 mol % or more of silver chloride.

7. The silver halide emulsion of claim 1, wherein the at least one of the outer shells and the inner shell which are positioned inside of the outermost shell contains 60 mol % or more of silver bromide.

8. The silver halide emulsion of claim 1, wherein the at least one of the outer shells and the inner shell which are positioned inside of the outermost shell contains 70 mol % or more of silver bromide.

9. The silver halide emulsion of claim 1, wherein the tabular silver halide grains have an aspect ratio of 4 to 20.

10. The silver halide emulsion of claim 1, wherein the tabular silver halide grains have a circle-corresponding diameter of 10 μm or less and a variation coefficient (with respect to distribution of the diameter) of 0 to 0.3.

11. The silver halide emulsion of claim 1, wherein the tabular silver halide grains have a variation coefficient (with respect to distribution of the diameter) of 0 to 0.2.

12. The silver halide emulsion of claim 1, wherein the tabular silver halide grains have an aspect ratio of 4 or more.

13. A silver halide photographic material comprising a support having thereon at least one red-sensitive silver halide emulsion layer, at least one green-sensitive silver halide emulsion layer, at least one blue-sensitive silver halide emulsion layer, and at least one light-insensitive layer, a color developing agent, and a coupler which forms a dye on coupling reaction with an oxidation product of the color developing agent, wherein at least one of said red-sensitive silver halide emulsion layer, green-sensitive halide emulsion layer, or blue-sensitive silver halide emulsion layer contains a silver halide emulsion containing tabular silver halide grains in such an amount that the projected area of the tabular silver halide grains accounts for 30% or more of the entire projected area of silver halide grains contained in the emulsion, said tabular silver halide grains having:

(1) a multiple structure comprising one inner shell and one or more outer shells positioned outside of the inner shell, wherein the outermost shell of the outer shells contains 50 mol % or more of silver chloride and at least one of the outer shells and the inner shell which are positioned inside of the outermost shell contains 50 mol % or more of silver bromide;

(2) {100} faces as two main planes parallel to each other; and (3) an aspect ratio of 2 or more.

14. The silver halide color photographic material of claim 13, wherein the amount of the color developing agent incorporated in the photographic material is from 0.5 to 40 mol % based on the total amount of the light-sensitive silver halide.

15. The silver halide color photographic material of claim 13, which comprises two or more light-sensitive silver halide emulsion layers having the same color sensitivity but different sensitivity and each containing a color developing agent, wherein the molar ratio of the amount of the color developing agent to the amount of the light-sensitive silver halide is smaller in a silver halide emulsion layer having a higher sensitivity than in a silver halide emulsion layer having a lower sensitivity.

16. The silver halide color photographic material of claim 13, which comprises two or more light-sensitive silver halide emulsion layers having the same color sensitivity but different sensitivity and each containing a color developing agent, wherein the molar ratio of the amount of the color developing agent to the amount of the light-sensitive silver halide is indirectly related to the sensitivity of the silver halide emulsion layer, such that the molar ratio of the amount of the color developing agent to the amount of the light-sensitive silver halide in a first layer having a sensitivity which is higher than that of a second layer will be lower than the molar ratio in the second layer.

17. The silver halide emulsion of claim 13, wherein the tabular silver halide grains have an aspect ratio of 4 or more.

18. The silver halide emulsion of claim 17, wherein the tabular silver halide grains have an aspect ratio of 4 to 20.

* * * * *